US009879365B2

(12) United States Patent
Ahmed

(10) Patent No.: US 9,879,365 B2
(45) Date of Patent: Jan. 30, 2018

(54) RAPIER LOOM

(71) Applicant: Ansari Akhlaque Ahmed Zahir Ahmed, Thane (IN)

(72) Inventor: Ansari Akhlaque Ahmed Zahir Ahmed, Thane (IN)

( * ) Notice: Subject to any disclaimer, the term of this patent is extended or adjusted under 35 U.S.C. 154(b) by 0 days.

(21) Appl. No.: 15/213,401

(22) Filed: Jul. 19, 2016

(65) Prior Publication Data

US 2017/0016155 A1 Jan. 19, 2017

Related U.S. Application Data

(63) Continuation of application No. PCT/IN2015/000034, filed on Jan. 20, 2015.

(30) Foreign Application Priority Data

Jan. 22, 2014 (IN) ..... 226/MUM/2014

(51) Int. Cl.

| | |
|---|---|
| ***D03C 1/00*** | (2006.01) |
| ***D03C 13/00*** | (2006.01) |
| ***D03D 47/27*** | (2006.01) |
| ***D03D 47/12*** | (2006.01) |
| ***D03D 47/18*** | (2006.01) |
| ***D03D 47/23*** | (2006.01) |
| *D03C 1/16* | (2006.01) |

(52) U.S. Cl.

CPC ..... *D03D 47/271* (2013.01); *D03C 1/00* (2013.01); *D03D 47/12* (2013.01); *D03D 47/18* (2013.01); *D03D 47/23* (2013.01)

(58) Field of Classification Search

CPC ..... D03D 31/00; D03D 13/004; D03D 47/38; D03D 13/00; D03D 39/223; D03D 47/263; D03D 49/46; D03D 49/62; D03D 51/02; D03C 7/06; D03C 7/005; D03C 13/00; D03C 19/005; D03C 13/02; D03C 1/00; D03C 1/146; D03C 1/16; D03C 1/14

See application file for complete search history.

(56) References Cited

U.S. PATENT DOCUMENTS

| | | | | | |
|---|---|---|---|---|---|
| 2,542,677 | A * | 2/1951 | Kane | D03D 31/00 | 139/49 |
| 3,042,081 | A * | 7/1962 | MacIsaac, Jr. | D03D 27/06 | 139/46 |
| 4,429,722 | A * | 2/1984 | Herzog | D03C 7/005 | 139/48 |
| 4,721,135 | A * | 1/1988 | Tsubata | A44B 18/0023 | 139/46 |
| 4,852,618 | A * | 8/1989 | Zollinger | D03D 47/38 | 139/453 |
| 5,582,213 | A * | 12/1996 | Okawa | D03C 7/005 | 139/46 |

(Continued)

*Primary Examiner* — Bobby Muromoto, Jr.
(74) *Attorney, Agent, or Firm* — Ryan Alley IP

(57) ABSTRACT

A rapier loom having at least a first rapier provided between at least a first frame from a pair of frames and at least a dobby frame of a dobby machine communicable coupled with the loom, the rapier being adapted to by operatively horizontally displaced; and at least a second rapier provided between at least a second frame from a pair of frames and at least a dobby frame of a dobby machine communicably coupled with the loom, the rapier being adapted to be operatively horizontally displaced.

20 Claims, 26 Drawing Sheets

(56) References Cited

U.S. PATENT DOCUMENTS

| | | | | |
|---|---|---|---|---|
| 6,257,283 | B1 * | 7/2001 | Lenzi | D03D 13/00 139/50 |
| 7,438,092 | B2 * | 10/2008 | Wahhoud | D03C 1/00 139/1 E |
| 8,011,998 | B2 * | 9/2011 | Lamarche | B24B 55/10 451/456 |
| 8,733,406 | B2 * | 5/2014 | Hannes | D03C 7/06 139/1 R |
| 8,770,235 | B2 * | 7/2014 | Wahhoud | D03C 7/06 139/188 R |
| 2001/0039974 | A1 * | 11/2001 | Wahhoud | D03D 39/223 139/25 |
| 2003/0066569 | A1 * | 4/2003 | Wahhoud | D03C 3/20 139/110 |
| 2003/0070721 | A1 * | 4/2003 | Wahhoud | D03C 3/20 139/435.1 |
| 2003/0136459 | A1 * | 7/2003 | Laycock | D03D 15/08 139/421 |
| 2003/0178087 | A1 * | 9/2003 | Odenthal | D21F 1/0045 139/383 A |
| 2004/0065380 | A1 * | 4/2004 | Speich | D03C 19/005 139/383 R |
| 2007/0295423 | A1 * | 12/2007 | Wahhoud | D03C 1/00 139/52 |
| 2010/0319801 | A1 * | 12/2010 | Legrand | D03C 13/00 139/11 |
| 2013/0105029 | A1 * | 5/2013 | Hannes | D03C 7/06 139/11 |
| 2013/0340881 | A1 * | 12/2013 | Boegl | D03C 1/146 139/55.1 |

* cited by examiner

RAPIER LOOM

FIELD OF THE INVENTION

This invention relates to the field of looms.

Specifically, this invention relates to a Rapier loom and associated Dobby machine.

BACKGROUND OF THE INVENTION

A network of threads or of a yarn is woven together to form a textile, which is typically a flexible fabric. This weaving process is facilitated by use of a loom. A loom is a device used to weave cloth. The basic purpose of any loom is to hold the warp threads under tension to facilitate the interweaving of the weft threads.

A loom comprises a 'template' known as warp yarn, which is a lengthwise parallel configuration of yarn threads upon and through which a weft yarn is woven. The weft yarn is the yarn, which provides to cause the woven fabric in accordance with pre-defined shapes and settings of the loom. Typically, a warp yarn comprises two planes of yarn thread such that the two planes are spaced apart for the weft yarn to pass through. Typically, a shuttle i.e. a housing for a bobbin (kandi) (bobbin is a thread bearing rod such that the thread is wound around the rod, and one end of the thread is free to be unwound from the bobbin (kandi) and be used for weaving purposes) moves between the space between the parallel planes formed by the warp yarn, in order to weave a fabric.

A rapier loom is a shuttleless weaving loom in which the filling yarn is carried through the shed of warp yarns to the other side of the loom by finger-like carriers called rapiers. One type has a single long rapier that reaches across the loom's width to carry the filling to the other side. Another type has two small rapiers, one on each side. One rapier carries the filling yarn halfway through the shed, where it is met by the other rapier, which carries the filling the rest of the way across the loom.

A stationary package of yarn is used to supply the weft yarns in the rapier machine. One end of a rapier, a rod or steel tape, carries the weft yarn. The other end of the rapier is connected to the control system. The rapier moves across the width of the fabric, carrying the weft yarn across through the shed to the opposite side. The rapier is then retracted, leaving the new pick in place.

Rapier Loom.

Rapier machines weave more rapidly than most shuttle machines but more slowly than most other projectile machines. An important advantage of rapier machines is their flexibility, which permits the laying of picks of different colors. They also weave yarns of any type of fiber.

SUMMARY OF THE INVENTION

An object of the invention is to provide a Rapier loom.

Another object of the invention is to provide a Rapier loom with single rapier as well as with two rapiers, three rapiers, four rapiers, and the like.

Yet another object of the invention is to provide a Rapier loom which provides a unique manufactured quality of binding method in a cloth or fabric.

Still another object of the invention is to provide a Rapier loom which provides a unique design in a cloth or fabric.

An additional object of the invention is to provide a Rapier loom which provides a binding or decorative material using a cloth or a fabric such that there may be a decorative or hard material on the outside and a binding or soft material on the inside.

Yet an additional object of the invention is to provide a Rapier loom which is used to make rugs, carpets, shirting material, suiting material, dress material, curtains, bed-sheets, sheet covers, and many such types of unique designed cloth or fabric, wherein 1 to 22 or more different colour weft yarn may be used in the cloth or fabric using a single machine.

Still an additional object of the invention is to provide a Rapier loom which incorporates 1 or 2 or 3 or 4 Rapiers.

Another additional object of the invention is to provide a Rapier loom which can use up to 4 colours of a weft yarn, one at a time, in 4 Rapiers.

Yet another additional object of the invention is to provide a Rapier loom wherein head is changeable with 22 or more colour weft yarn.

According to this invention, there is provided a Rapier loom comprising:

- at least a main support beam pipe on a framework, said main support beam pipe being located posterior on said framework;
- at least a yarn shaft located on said main support beam pipe in order to accommodate yarns;
- rocking frame located on the internal side of said framework;
- at least a gear being located on said beam pipe, on a first lateral side of said framework, said gear adapted to drive said rocking frame in its rocking manner, for weaving operation of said loom; and
- at least a rod, located on a second lateral side of said framework, said rod comprising a first worm and worm wheel on its operative top side and a bevel gear at its operative bottom side;
- at least a gear assembly connected to a pair of frames such that the movement of gears facilitates the movement of frames in an upward and downward direction opposite to each other's movements;

characterised in that,

- at least a first Rapier provided between at least a first frame from said pair of frames and at least a Dobby frame of a Dobby machine communicably coupled with said loom, said Rapier being adapted to be operatively horizontally displaced; and
- at least a second Rapier provided between at least a second frame from said pair of frames and at least a Dobby frame of a Dobby machine communicably coupled with said loom, said Rapier being adapted to be operatively horizontally displaced.

Typically, said loom comprises at least an angularly or linearly displaceable shaft, said displacement further providing operative lateral movement to at least a first link arm with a distal slot in which an operative vertical rod (or main shaft) is located, said vertical rod (or main shaft) being a link and driving force for at least an operatively horizontally located rapier wherein, in once cycle, while rocker arm completes one cycle of rocking motion, said at least a rapier moves from an operative centre to operative left and back to said operative centre, and further while one needle moves up and down, a rapier thread(s) engages with a needled thread(s) and moves back to a centre position.

Typically, said loom comprises at least a first sewing assembly with a needle holder and a needle such that that is engaged with said needle by means of said thread holder, and wherein said sewing assembly and optionally at least a Dobby machine operates from at least a first shaft.

Typically, said loom is a single comprising two or three of four Rapiers used in parallel to each other such that with two rapiers, two yarns may be used, with three rapiers, three yarns may be used, and with four rapier, four yarns may be used.

Typically, said loom is a single comprising two or three of four Rapiers used in parallel to each other such that with two rapiers, four yarns may be used, with three rapiers, six yarns may be used, and with four rapier, eight yarns may be used.

Typically, said at least a rapier is induced with laterally oriented repetitive motion in relation to the lateral movement of said first link arm, said at least a rapier being adapted to receive threads from yarns, said threads from said rapiers being laterally moved along with said at least a corresponding rapier and engaging with a thread of a needle of a sewing assembly.

Typically, said at least a rapier comprises an angularly displaceable frame which is angularly displaceable about a shaft such that as said first shaft is angularly displaced, a second link arm with a distal slot is laterally moved, which, in turn, moves said shaft in an angularly displaceable manner.

Typically, needle assembly is located at either ends of said rapier such that when said rapier moves towards one end, it engages with the needled thread at one end, and then moves to the other end to engage with the needled thread at the other end.

Typically, said rapiers engage with an assembly for selection of threads, based on motion of said rocking frame, said assembly comprises:

at least a first head portion with a first head part at its operative distal end and a recessed part in said first head portion at its operative proximal end, said first head part is a tapering substantially pointed head part, at least a second abutting portion with a second head part at its operative distal end, said second head part is adapted to engage in to and disengage out of said recessed part of said first head portion;

locking mechanisms provided in order to allow for engaging and disengaging of said second portion with said first portion;

at least a hole provided at the tip of said first head part where a thread is engaged;

at least a plurality of such first head portions are linearly aligned on a block, said first head portions being equivalent to the number of different threads that may be provided for use with rapiers;

a plurality of the second abutment portions linearly aligned in a spaced apart manner from each other and also spaced apart from said first head portion such that a user may select which thread is to be used and accordingly engages said second abutment portion in to said first head portion in order to engage said thread at the tip of said first head part of said first head portion with the fabric that is to be woven, thereby allowing weft colours to be easily changed and wherein the block on which said first head portions and said second abutment portions are aligned are co-operatively engaged with at least a Dobby machine;

at least a rod provided which is relatively laterally stationary but moves operatively forward and backward in order to engage with said second abutment portion; and at least a movement assembly adapted to move said blocks laterally in order to aid selection of a particular thread.

Typically, said loom comprises at least two Dobby machines wherein a first Dobby machine is an operatively top located Dobby machine or a second Dobby machine is an operatively bottom located Dobby machine.

Typically, said Dobby machine comprises:

jack adapted to be displaced in an operative forward and an operative backward direction, said jack being mounted on a jack shaft, said jack shaft being adapted to be placed on said framework of said power loom, in a pre-defined configuration, advantageous to said assembly;

catch lever adapted to engage said jack;

connecting collar shaft with a knife at its operative distal end, said connecting collar shaft adapted to engage with said jack, said knife being adapted to move in an operative forward and operative backward direction;

catch wheel adapted to be engaged with said knife in the operative forward direction of said knife, said catch wheel being a spiked or toothed circumferential assembly, said catch wheel being further adapted to be disengaged from said knife in the operative backward direction of said knife, said forward engagement and rearward disengagement being a cyclical operation; and bush bearing shaft, push catch bush, a push catch plate, push catch body, and push catch pointer being advantageously aligned in order to effect the forward motion of said connecting collar shaft and said knife on to a push catch pointer such that it engages with said catch wheel in order to stop its angular displacement.

Typically, said Dobby machine comprises frames adapted to be displaced in an operative backward direction, when said jack is displaced in an operative backward direction, said backwards motion resulting in pulling operation of said frames, said frames being tensioned frames such that an operative upward motion of said frames is due to said jack shaft and jack movement in the backward direction and further such that said tension in said frames causes its downward movement, and thus, cyclical upward and downward motion of the frames is established in accordance with the working of said Dobby machine, said cyclical upward and downward motion of said frames being in correspondence with said forward and backward motion of said jack.

Typically, said Dobby machine comprises:

barrel shaft mounted barrel adapted on include slotted bars on its circumference, said slotted bars being axial or longitudinal slotted bars with bars in the axial or longitudinal direction of the barrel shaft and the slots in between two adjacent bars in the same axial or longitudinal direction of said barrel shaft plurality of elongate bars adjacent each other, said elongate bars comprising a plurality of notches on its operative top face, said notches being defined in a linear manner and further being adapted to receive stubs in accordance with designs or patterns to be created on the fabric that is to be woven by said power loom and said Dobby machine; and stubs being located in said as and how required in accordance with the pattern to be weaved along with said fabric, such that as said barrel is angularly displaced by said barrel shaft, it encounters said stubs on said notches as the barrel with slotted bars angularly displaces over the notched elongate bars comprising studs in a pre-determined manner, thereby causing operative upwards motion of said barrel and said frames due to said stubs, said various stubs forcing frames or various frames to be displaced operatively upwards.

Typically, said power loom comprises:

said framework such that a first shaft being a crank shaft being operatively transversely located at a first pre-defined position across said framework;

said framework such that a yarn shaft being operatively transversely located at a second pre-defined position across said framework, said yarn shaft being adapted to accommodate multiple yarns fitted around it may be transversely located;

said framework such that a bearing support being transversely located at a third pre-defined position across said framework;

said framework such that a second shaft being operatively transversely located at a fourth pre-defined position across said framework;

said framework such that a third shaft being operatively transversely located at a fifth pre-defined position across said framework;

said framework such that a fourth shaft being operatively transversely located at a sixth pre-defined position across said framework;

said framework such that a fifth shaft being operatively transversely located at a seventh pre-defined position across said framework;

said framework such that a pre-defined first shaft being placed over a pre-defined second shaft;

said framework such that a pre-defined third shaft being placed over a pre-defined first shaft;

said framework such that a pre-defined fourth shaft being placed over a pre-defined third shaft;

said framework such that a pre-defined third shaft being coupled to a pre-defined fourth shaft by a gear assembly;

said framework such that a pre-defined fourth shaft being moved by said second shaft.

Additionally, said Rapier loom comprises a switch with a three phase supply adapted to control mode of working of said loom, said modes being selected from a forward direction mode or a reverse direction mode.

Additionally, said Rapier loom comprises a switch with a three phase supply adapted to control mode of working of said loom, said modes being selected from a forward direction mode or a reverse direction mode, said switch comprising an electric changer connected to a lever, position of said lever adapted to decide a signal that is given from said electric changer to an electric motor such that a first position of lever stops said motor, a second position of lever operates said motor in a clockwise rotation, and a third position of lever operates said motor in an anti-clockwise rotation.

Typically, said rocking frame comprises:

first arm being an effort arm;

second arm being a load arm and a weighted arm;

fulcrum between said first arm (effort arm) and said second arm (load arm);

motor adapted to swing or rock said first arm and thereby adapted to rock/swing said second arm in an opposite direction, said weighted second arm adapted to reverse push or pull of said motor, thereby bringing said rocking frame in position; and hook or latch adapted for actuation of said rocker frame or of the shuttle (bobbin or kandi) operation.

Typically, said Rapier loom comprises rolling means adapted to roll woven fabric.

Typically, said power loom comprises rolling means adapted to rolls woven fabric, said rolling means further comprising:

plurality of rollers adjacent each other so as to roll a fabric that is received between it;

frame assisting in the support of said rollers.

beam being a notched beam which includes notches for co-operating with a gear assembly for adjusting the position of a first roller with respect to a second roller in relation to the thickness of aid woven fabric to be rolled; and spring adapted to hold said second roller in place.

Additionally, said power loom comprises attachments, said attachments being selected from a group of attachments consisting of a 4×4 box, a 4×1 box, a 2×1 box, a Dobby machine or a Jacquard machine and tappets.

Typically, said Rapier loom is a shuttle-less power loom.

Typically, said Rapier loom comprises a ply or tray above said yarn shaft for collecting waste threads from the fabric above so that it does not fall on said yarn shaft.

Alternatively, said Dobby machine is replaced by Jacquard machines or any other design machine.

Typically, said loom comprises at least two Rapiers axially aligned facing each other such that said at least two Rapiers from either side meet at a centre, in response to operating cycles, where exchange of thread occurs.

Typically, said loom is at least a single loom assembly with at least two Rapiers.

Alternatively, said loom is at least a double loom assembly with at least two Rapiers.

BRIEF DESCRIPTION OF THE ACCOMPANYING DRAWINGS

The invention will now be described in relation the accompanying drawings, in which.

DETAILED DESCRIPTION OF THE ACCOMPANYING DRAWINGS

According to this invention, there is provided a Rapier loom.

Figure 1:
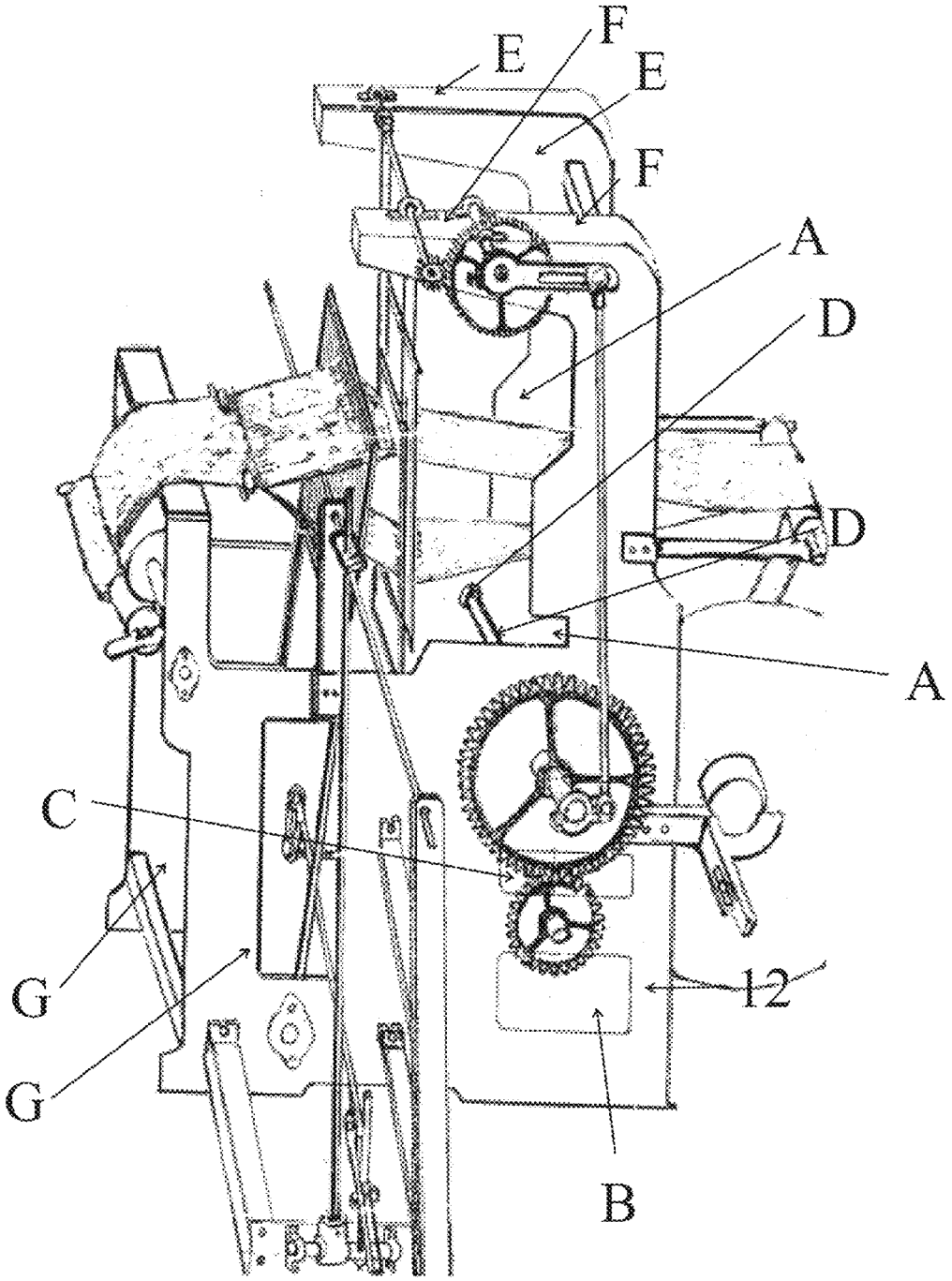
FIG. 1 illustrates a loom framework.
Figure 2:
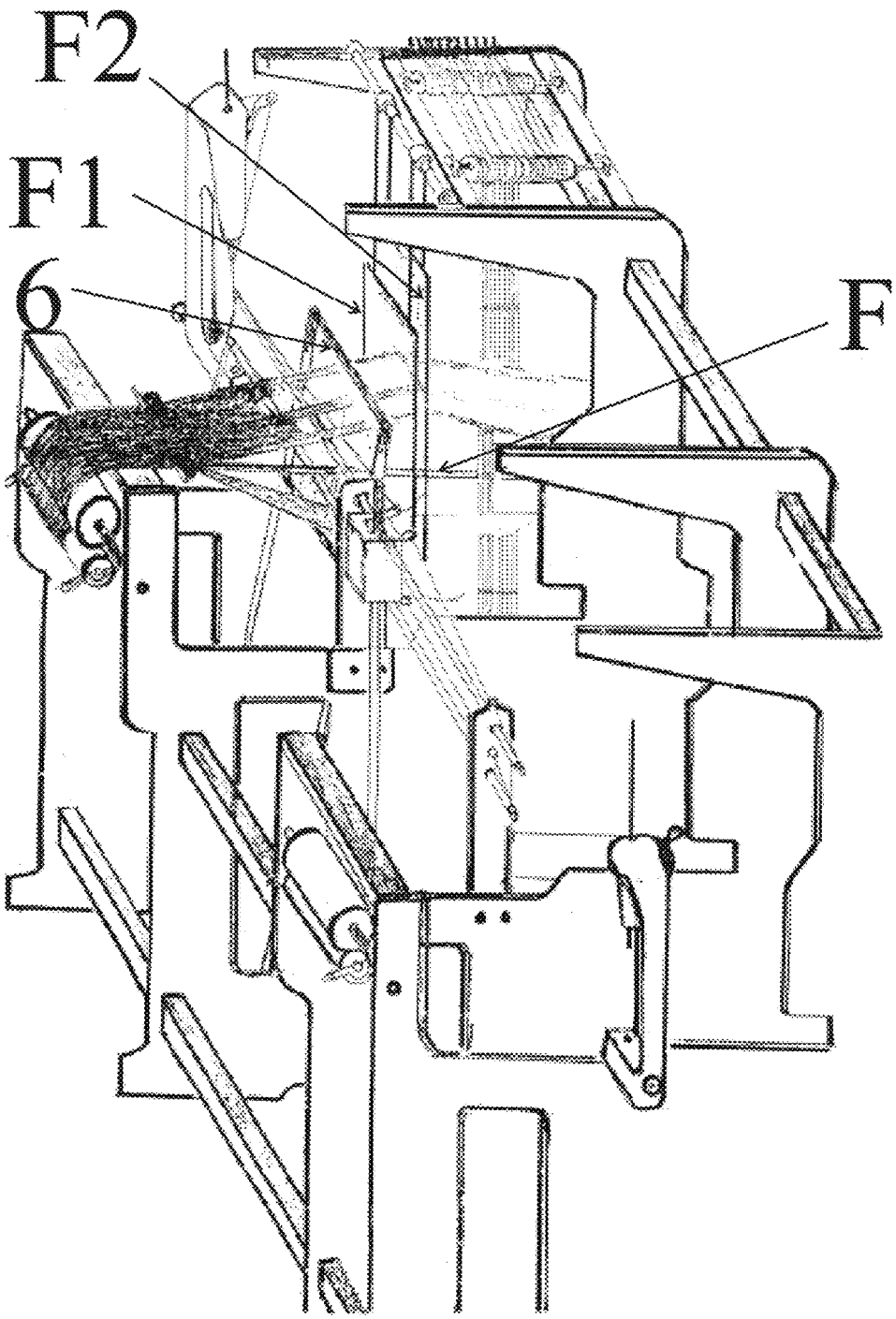
FIG. 2 illustrates another view of a loom framework.

In accordance with an embodiment of this invention, there is provided a casting body or a framework designed in a relatively reduced area. The framework is as shown in FIG. 1 of the accompanying drawings. The framework includes various slots for accommodating various shafts and other sub-assemblies of which the loom is comprised.

Reference numeral A-A refers to the position where a first crank shaft may be transversely located.

Reference numeral B-B refers to the position where a yarn shaft having multiple yarns fitted around it may be transversely located.

Reference numeral C-C refers to the position where a bearing support may be transversely located.

Reference numeral D-D refers to the position where a second shaft may be transversely located.

Reference numeral E-E refers to the position where a third shaft may be transversely located.

Reference numeral F-F refers to the position where a fourth shaft may be transversely located.

Reference numeral G-G refers to the position where a fifth shaft may be transversely located.

FIGS. 1, 2, 3, and 4 illustrate various views of the loom framework.

In accordance with another embodiment of this invention, there is provided a main beam support and beam pipe on the framework of FIG. 1. The main support beam support is shown by reference numeral 12. On the interior side of the beam support, yarn is provided. This yarn is on the yarn shaft B-B. As compared to the prior art, the location of the beam support in the frame is such that the frame width dimensions have reduced substantially; at least by up to half the width dimensions of the prior art. There is provided a rocking frame (16) shown in FIG. 2 of the accompanying drawings. A chain wheel gear (18) is located on the beam support (12) which drives the rocking frame (16) in its rocking manner. The gears, typically, are in the ratio 1:2. Alternatively, a pair of teethed wheels may be provided. The rocking frame (16) is located in the frame i.e. on the internal side of the framework. The teethed wheels are also, typically, in the ratio 1:2. As the larger wheel completes one revolution, the smaller wheel completes two revolutions, thereby causing a complete forward and complete backward rocker movement of the rocking frame (16). This movement is important for the loom for weaving.

Here, the beam support (12) is modified to allow an open area.

Figure 3:
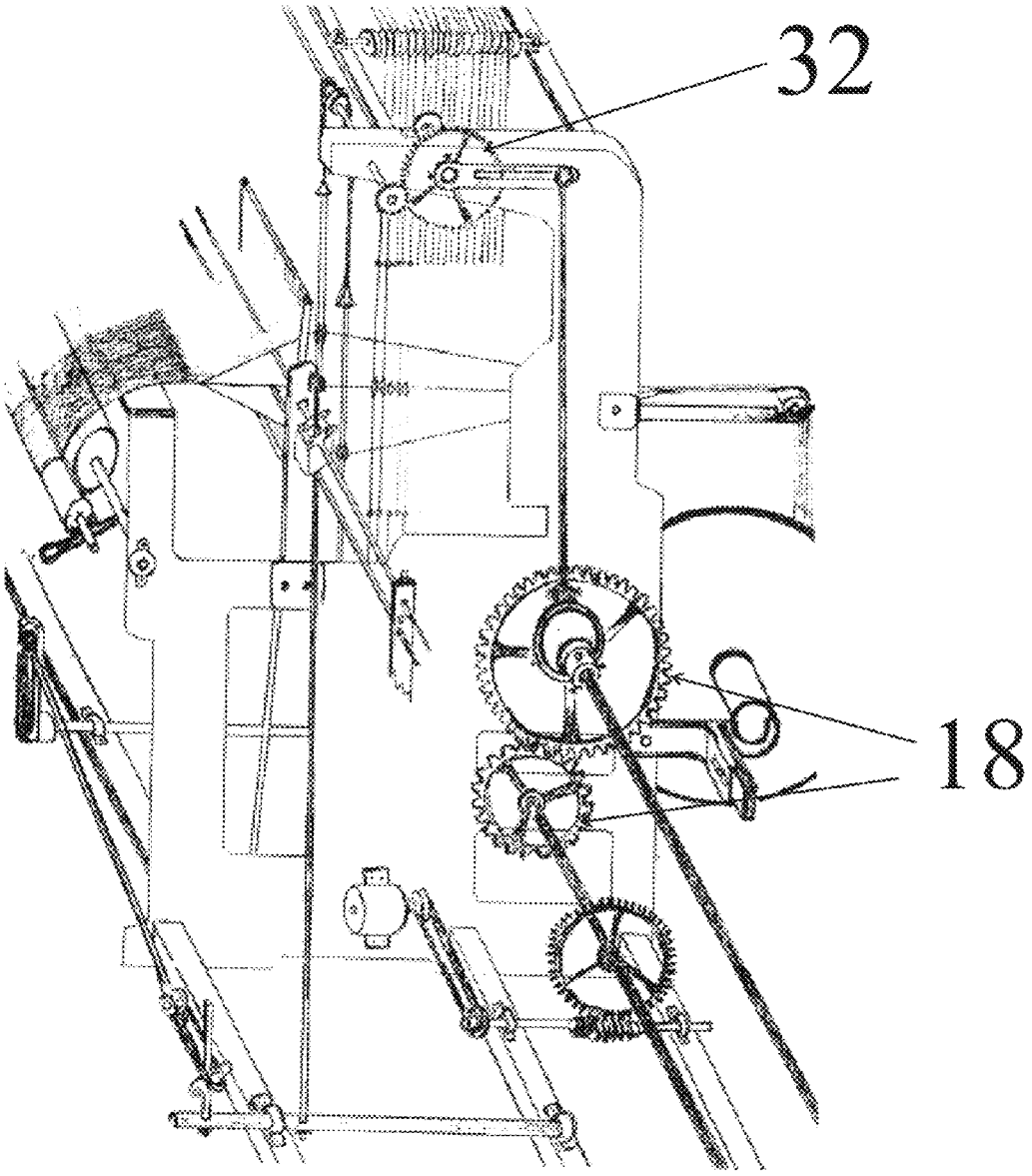
FIG. 3 illustrates another view of a loom framework.
Figure 4:
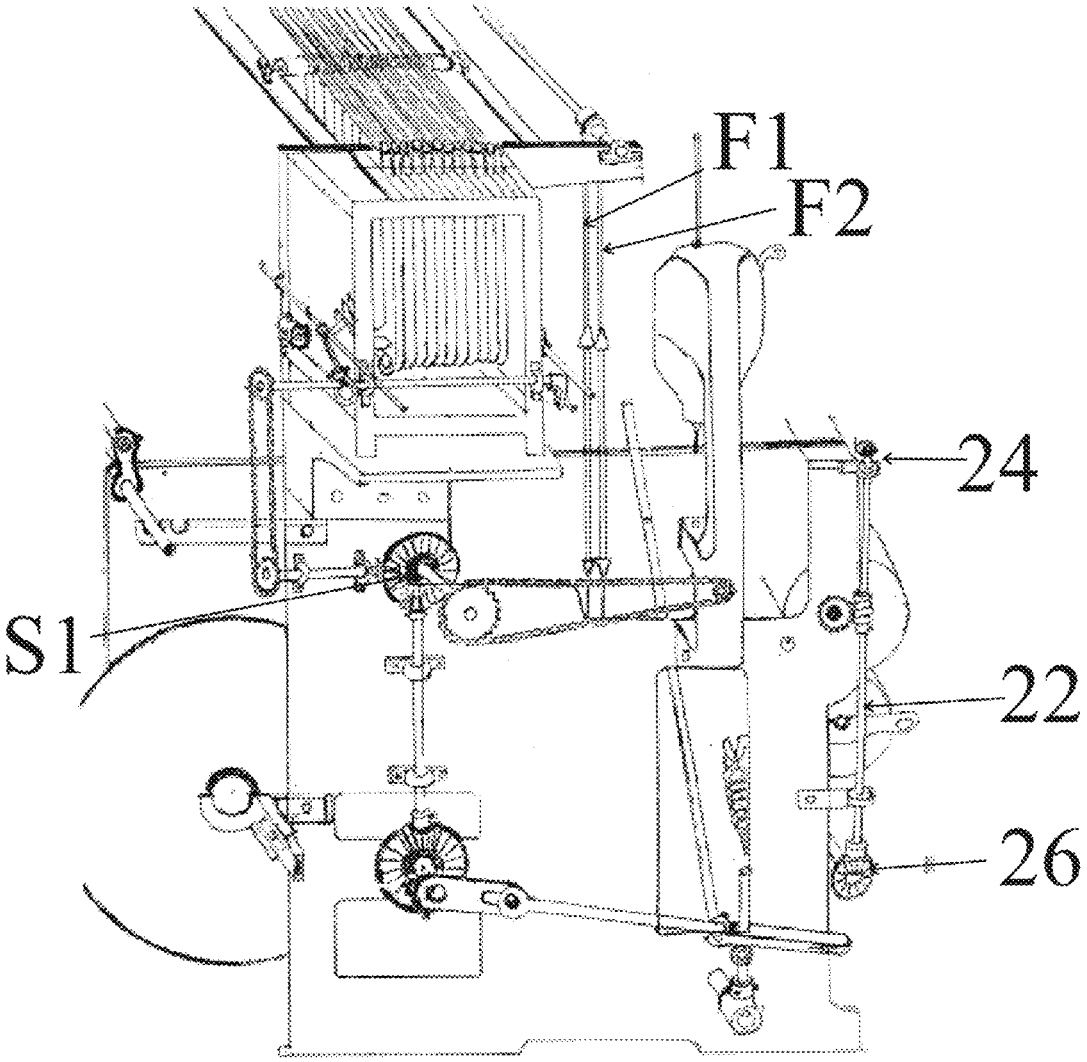
FIG. 4 illustrates another view of a loom framework.

On the other lateral side of the framework, there is a rod (22) with a first worm and worm wheel (24) on its operative top side and a bevel gear (26) at its operative bottom side. FIG. 3 illustrates a side view of the casting body or framework of the loom.

An electric motor (28) is connected to a second worm and worm wheel (30) such that as the worm wheel (30A) moves, the worm (30B) also moves, thereby causing the rocking frame (16) to rock. A gear assembly (32), located at operative top, and on the inner side of said framework, is provided. The gear assembly (32) is connected to shaft, S2. This gear assembly (32) is, in turn, connected to a pair of frames (F1 and F2) such that the movement of gears facilitates the movement of frames in an upward and downward direction opposite to each other's movements; i.e. when frame F1 moves up, frame F2 moves down and when frame F1 moves down, frame F2 moves up. Pipe rolls laterally extend from the beam support pipe (12) in order to guide the thread and space it apart from the framework. This thread is passed through the frames (F1 and F2) and then through the upper portion of the rocker arm (16) and Dobby frame (F) in the middle.

Figure 5:
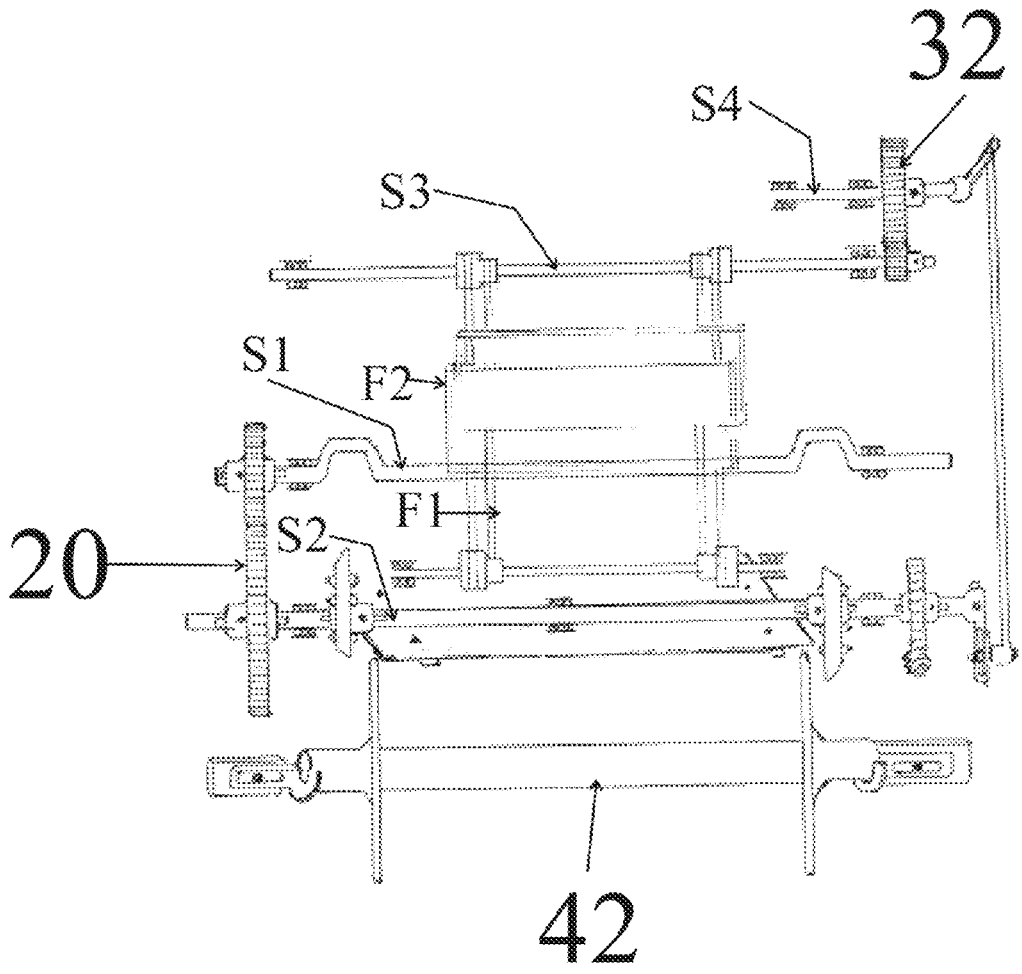
FIG. 5 illustrates a front view of the assemblies that lay in the loom framework of FIG. 1.

FIG. 5 illustrates a front view of the assemblies that lay in the framework of FIG. 1 of the accompanying drawings.

A pair of teethed wheels (20) meshes each other. Reference numeral 42 refers to yarn shaft.

The yarn shaft (42) which holds yarns can be seen. This yarn shaft (42) is placed at the location B-B of FIG. 1 of the accompanying drawings. There is a first shaft (S1) and a second shaft (S2) connected to each other by gear assembly (20). The first shaft (S1) is placed at the location A-A of FIG. 1 of the accompanying drawings. The second shaft (S2) is placed at the location D-D of FIG. 1 of the accompanying drawings. The first shaft (S1) is placed above the second shaft (S2). The third shaft (S3) is placed at the location E-E of FIG. 1 of the accompanying drawings. There is also a fourth shaft (S4) which is coupled to the third shaft (S3) by a gear assembly (32) (as shown in FIG. 5 of the accompanying drawings). The fourth shaft (S4) is placed above the third shaft (S3). The fourth shaft (S4) is placed at the location F-F of FIG. 1 of the accompanying drawings. The fourth shaft (S4) is moved by the second shaft (S2).

Figure 6A:
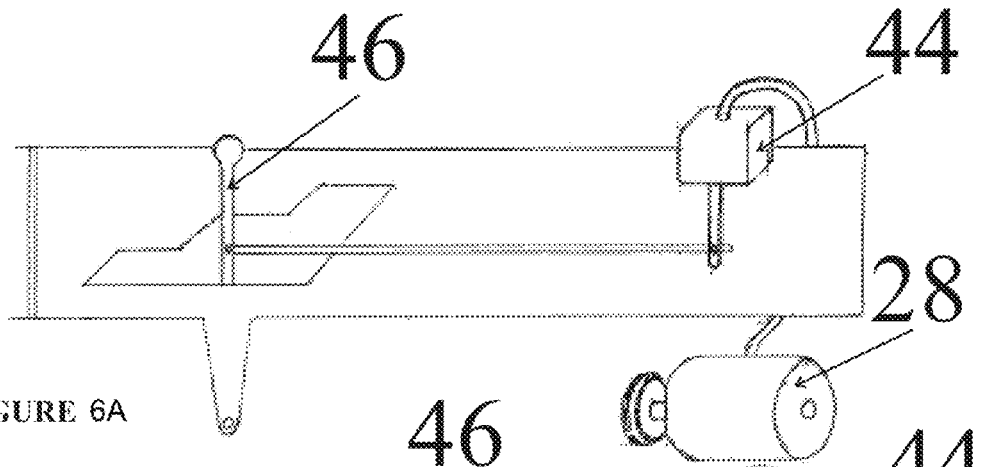
FIG. 6A illustrates a first view of a switch with a three phase supply which decides the mode of working of the loom.
Figure 6B:
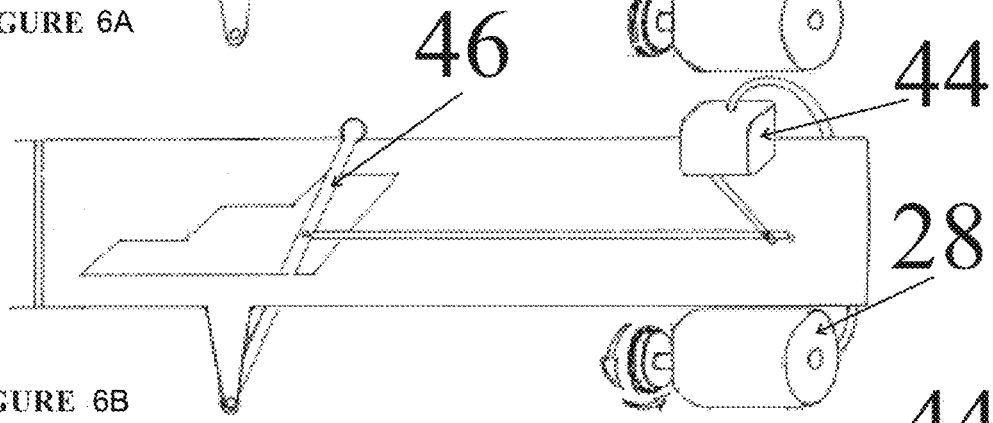
FIG. 6B illustrates a second view of a switch with a three phase supply which decides the mode of working of the loom.
Figure 6C:
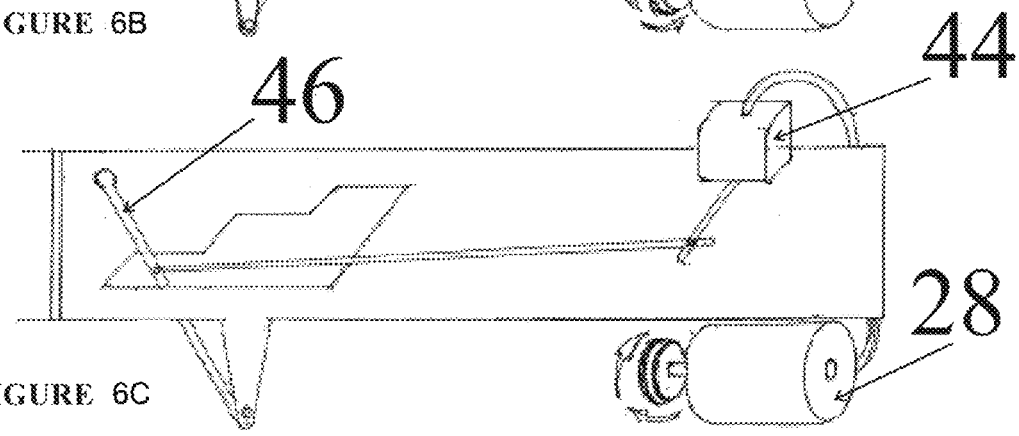
FIG. 6C illustrates a third view of a switch with a three phase supply which decides the mode of working of the loom.

FIG. 6 illustrates a switch with a three phase supply which decides the mode of working of the loom i.e. in forward direction or in reverse direction. Reference numeral 44 refers to an electric changer which is connected to a lever (46). The position of the lever (46) decides the signal that is given from the electric changer (44) to an electric motor (28). FIG. 8*a* illustrates stop condition of motor (28) when the lever (46) is in a first position. FIG. 8*b* illustrates clockwise rotation of motor (28) when the lever (46) is in a second position. FIG. 8*c* illustrates anti-clockwise rotation of motor (28) when the lever (46) is in a third position.

Figure 7:
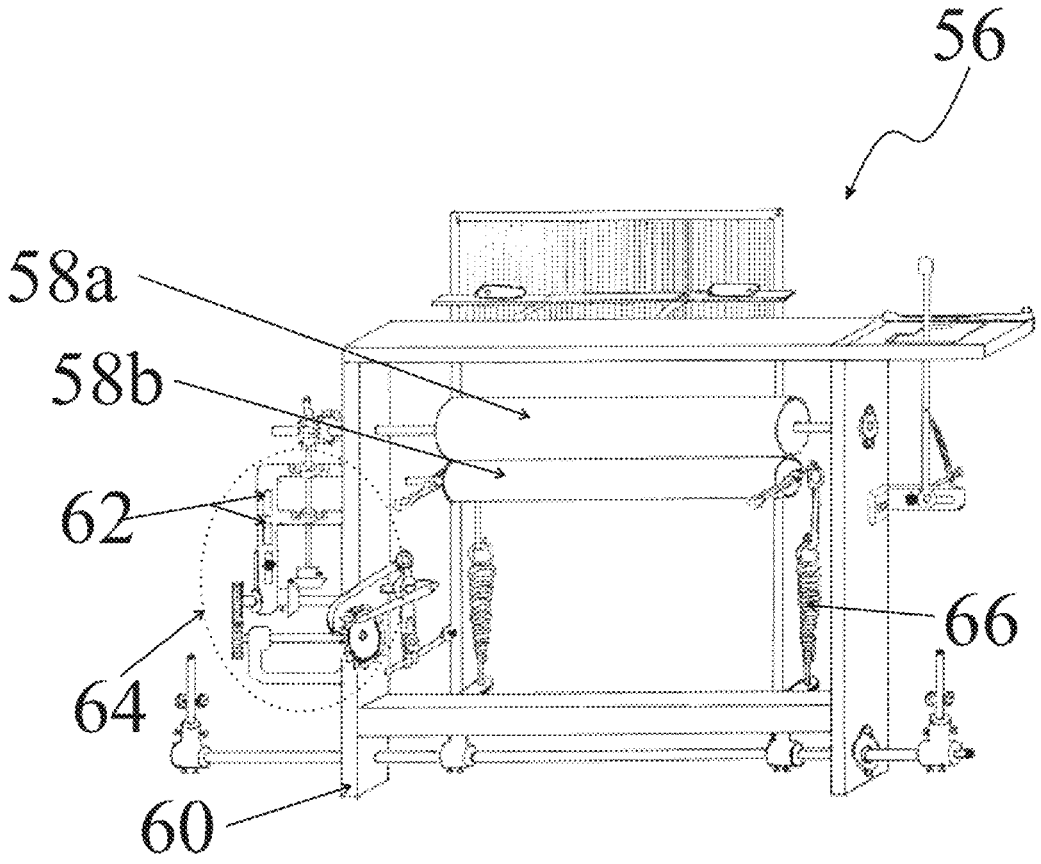
FIG. 7 illustrates a front view of the rolling means in the loom which rolls the fabric.

FIG. 7 illustrates a front view of the rolling means (56) in the loom which rolls the fabric.

Figure 8:
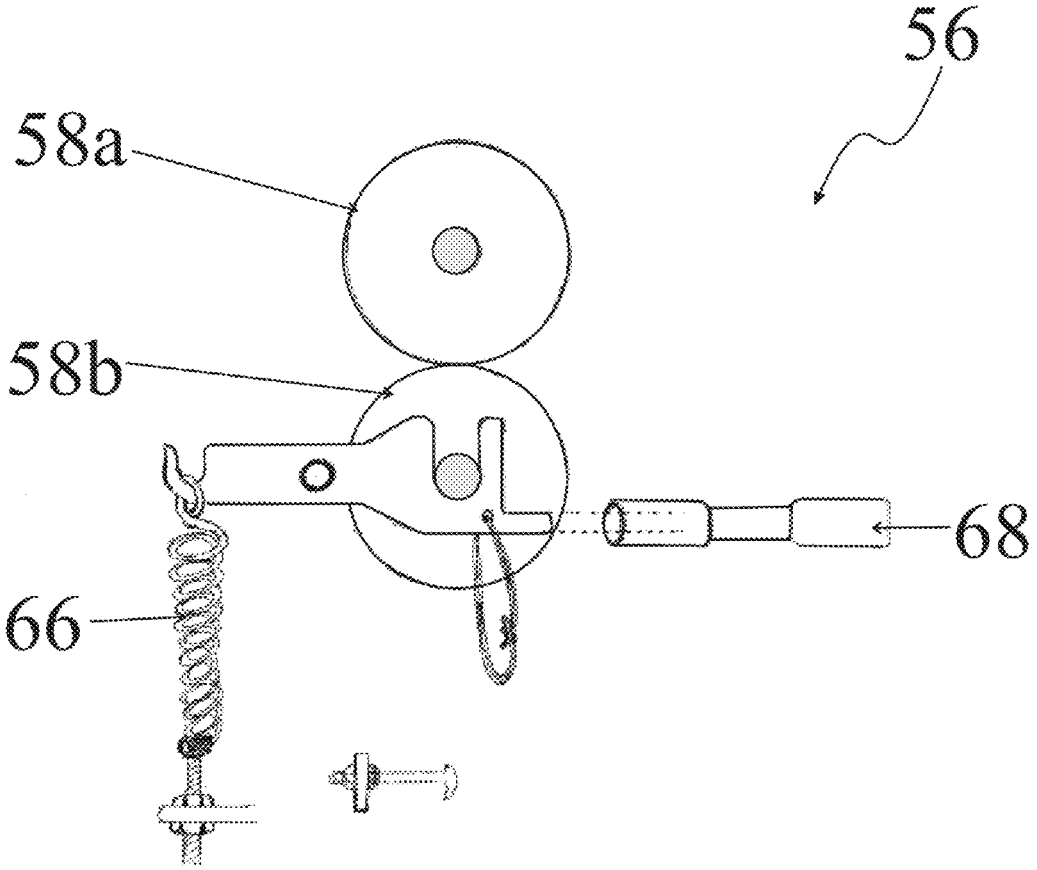
FIG. 8 illustrates a side view of the rolling means of FIG. 7.

FIG. 8 illustrates a side view of the rolling means (56) of FIG. 7.

In accordance with another embodiment of this invention, there is provided a plurality of rollers (58*a*, 58*b*) adjacent each other so as to roll a fabric that is received between it. A frame assists in the support of these rollers (58*a*, 58*b*). The beam (60) of the frame is a notched beam which includes notches (62) for co-operating with a gear assembly (64) for adjusting the position of the roller (58*a*) with respect to roller (58*b*) in relation to the thickness of the fabric to be rolled.

A spring (66) holds the lower roller (58*b*) in place. A handle (68) is provided which is a detachable handle to adjust the rollers.

Figure 9:
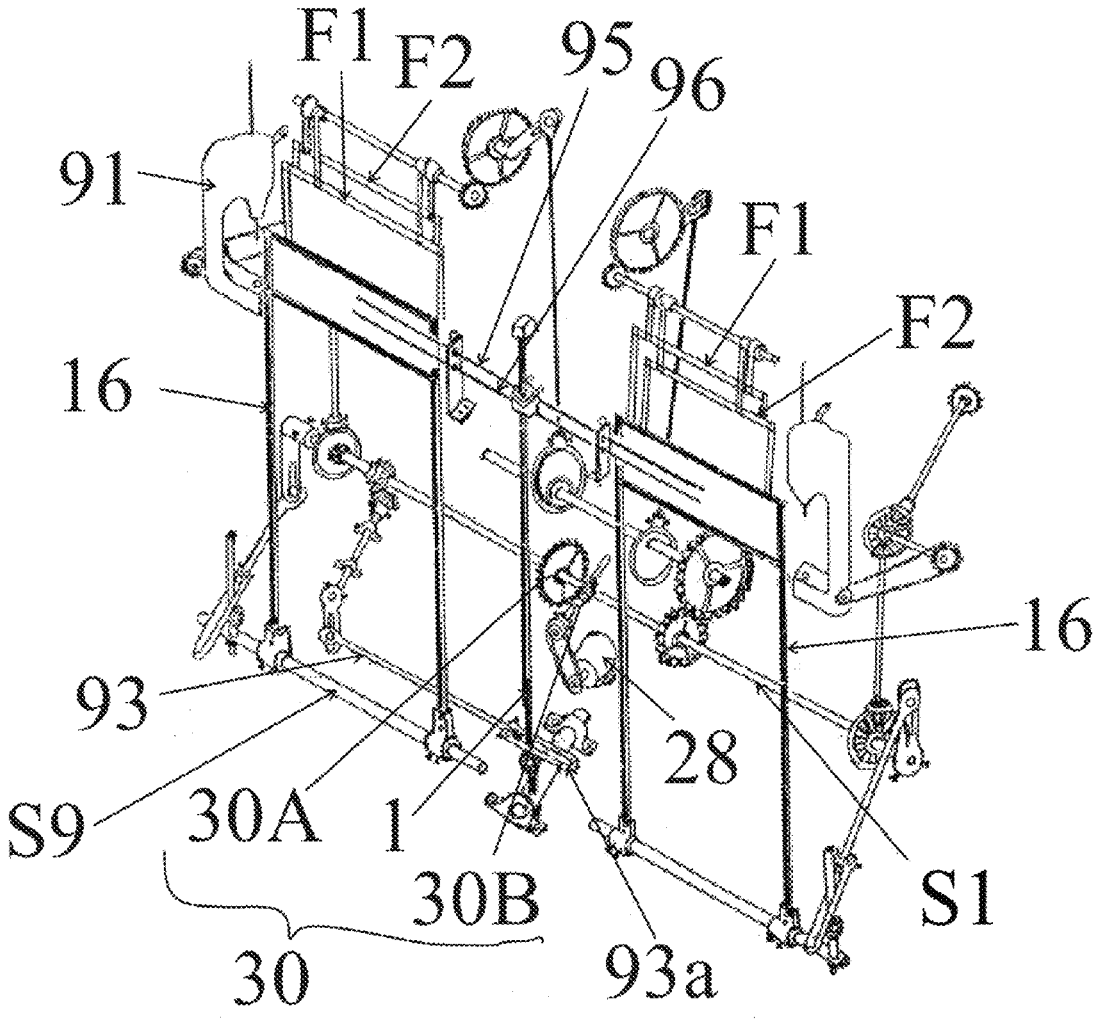
FIG. 9 illustrates an isometric view of the Rapier loom, according to this invention.

FIG. 9 illustrates an isometric view of the Rapier loom, according to this invention.

Figure 10:
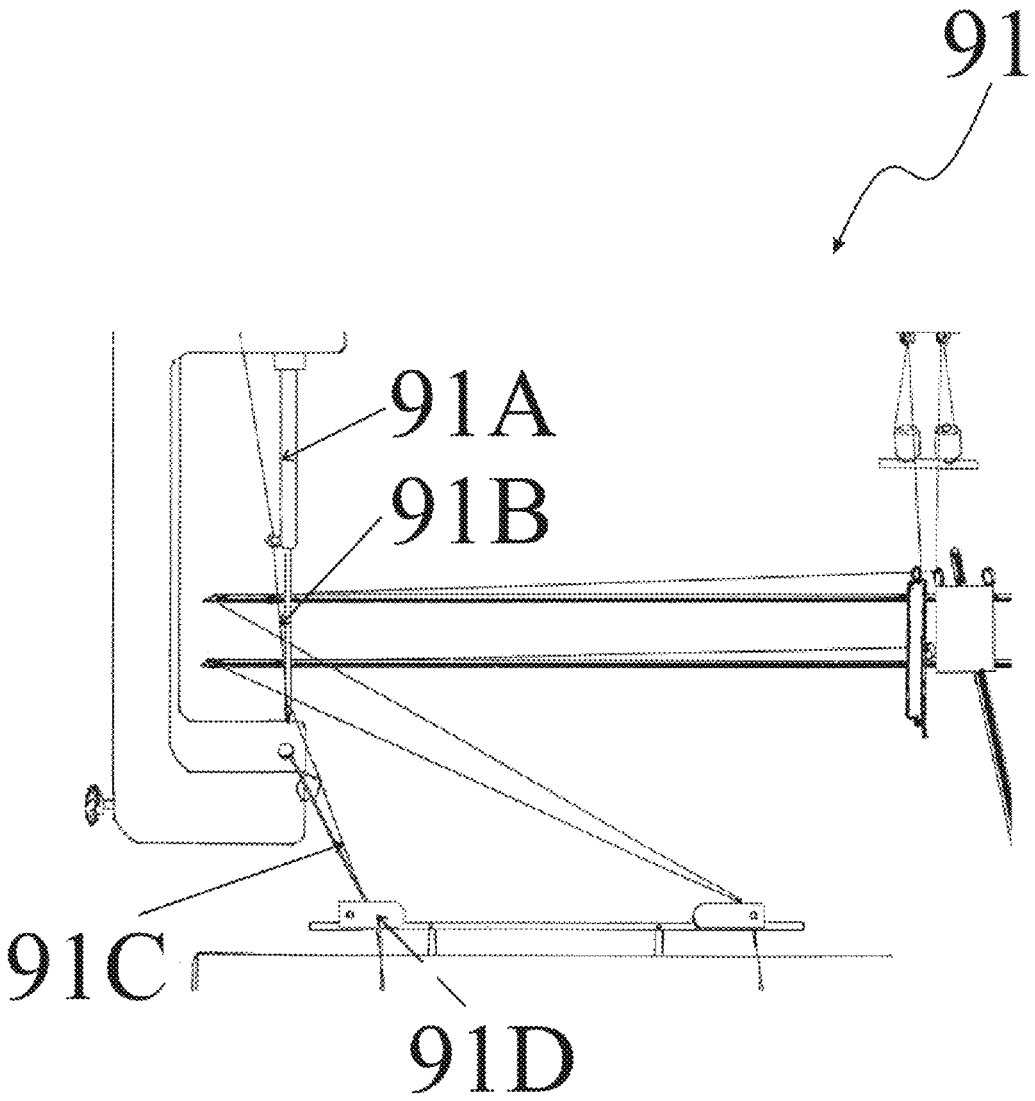
FIG. 10 illustrates two looms and two rapiers.
Figure 24:
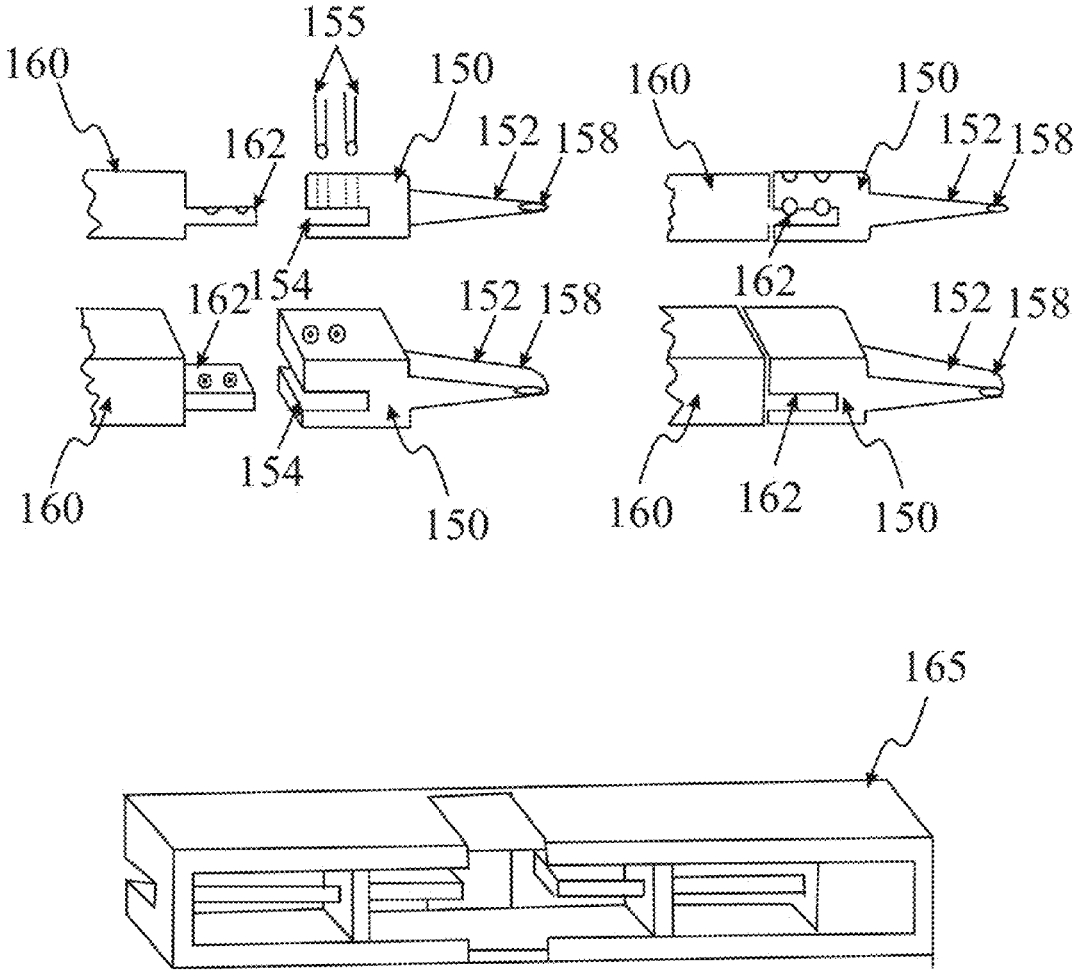
FIG. 24 illustrates a mechanism of Rapier looms which aid in selection of threads for use.

The electric motor (28) angularly displaces the shaft (S1). This displacement activates gears (30) and further provides lateral movement to a first link arm (93) with a distal slot (93*a*) in which an operative vertical rod i.e. main shaft (1) is located. The vertical rod (1) (as seen in FIG. 24 of the accompanying drawings) is a link and driving force for at least an operatively horizontally located rapier (95, 96, 120, 122). Reference numeral 91 refers to at least a first sewing assembly with a needle holder (91A) and a needle (91B). Thread (91C) that is engaged with the needle is seen in FIG. 10 of the accompanying drawings. The thread is engaged with a thread holder (91D). Sewing assembly (91) and Dobby machine (70) operates from shaft S1.

There may be two or three or four rapiers used in parallel to each other. The two rapiers are referenced 95 and 96. With two rapiers, four yarns can be used. These four yarns are seen as reference numerals 97A, 97B, 97C, and 97D in FIGS. 11 and 12 of the accompanying drawings.

Figure 11:
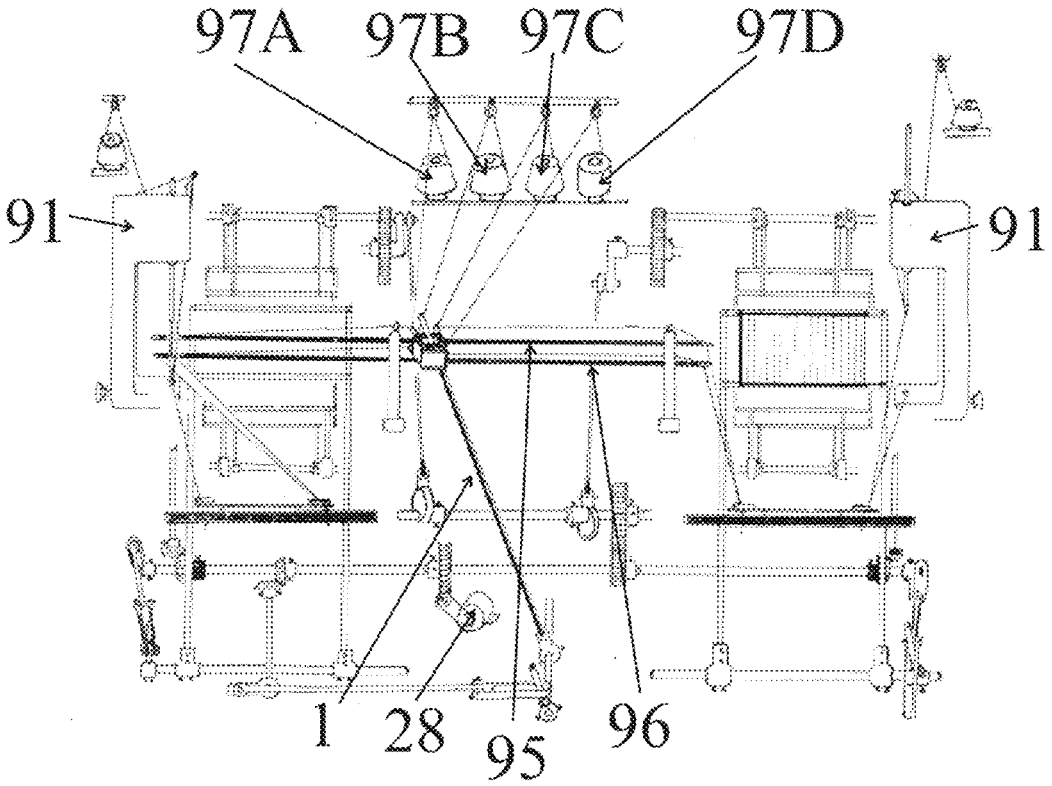
FIG. 11 illustrates two looms and two rapiers.
Figure 12:
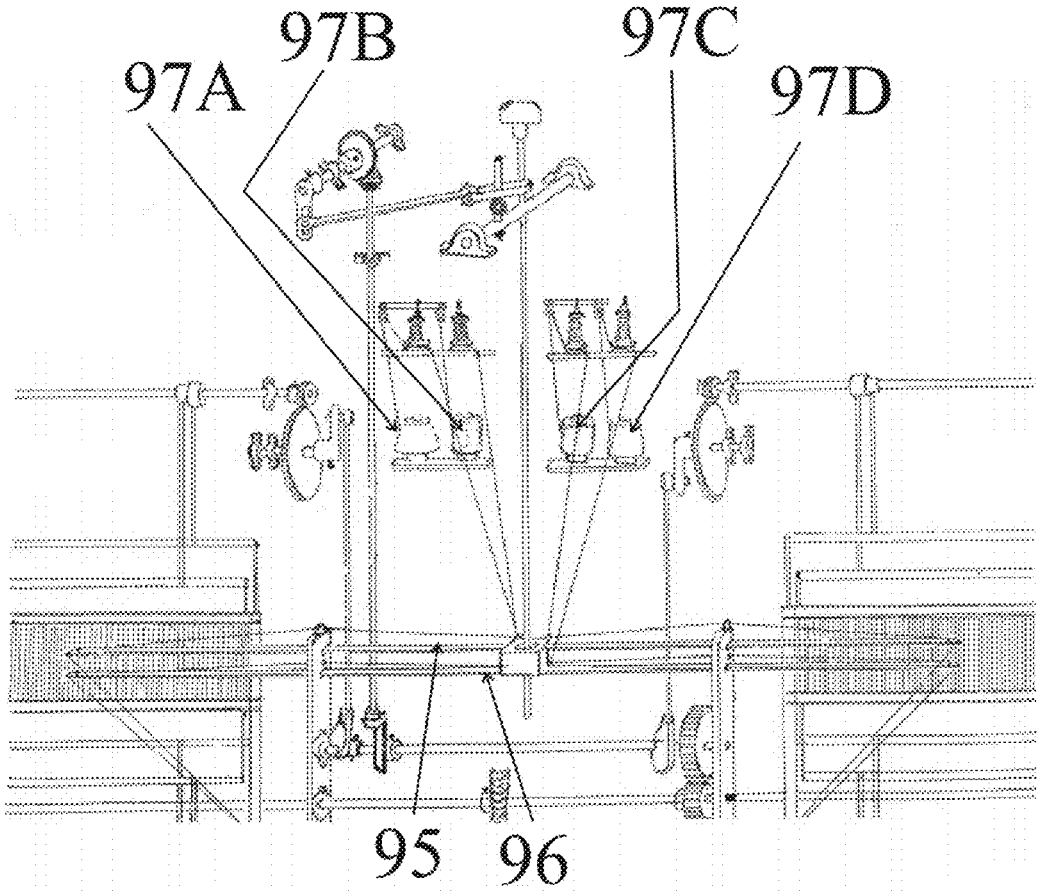
FIG. 12 illustrates two looms and two rapiers.

FIGS. 10, 11, and 12 illustrate two looms and two rapiers.

The rapiers (95, 96) are induced with laterally oriented repetitive motion in relation to the lateral movement of the first link arm (93). The rapiers receive threads from yarns as seen in FIGS. 9, 11, and 12 of the accompanying drawings. The threads from the rapiers are laterally moved along with the rapier and engage with the thread (91C) of the needle (91B).

Reference numeral 16 refers to an angularly displaceable frame which is angularly displaceable about shaft S9. As the motor (28) angularly displaces the shaft S1, a second link arm with a distal slot is laterally moved, which, in turn, moves the shaft S9 in an angularly displaceable manner.

With two rapiers, needle assemble are located at either lateral ends. The rapier(s) move simultaneously towards one end, engage with the needled thread at one end, and then move to the other end to engage with the needled thread at the other end. While one needle is up, the other needle is down, and vice versa.

In one cycle, rapier moves from centre to left and back to centre, rocker arm completes one cycle of rocking motion, one needle moves up and down, the rapier thread(s) engages with the needled thread(s) and moves back to the centre. Similar action, then takes place at the right hand side needle assembly.

Figure 13:
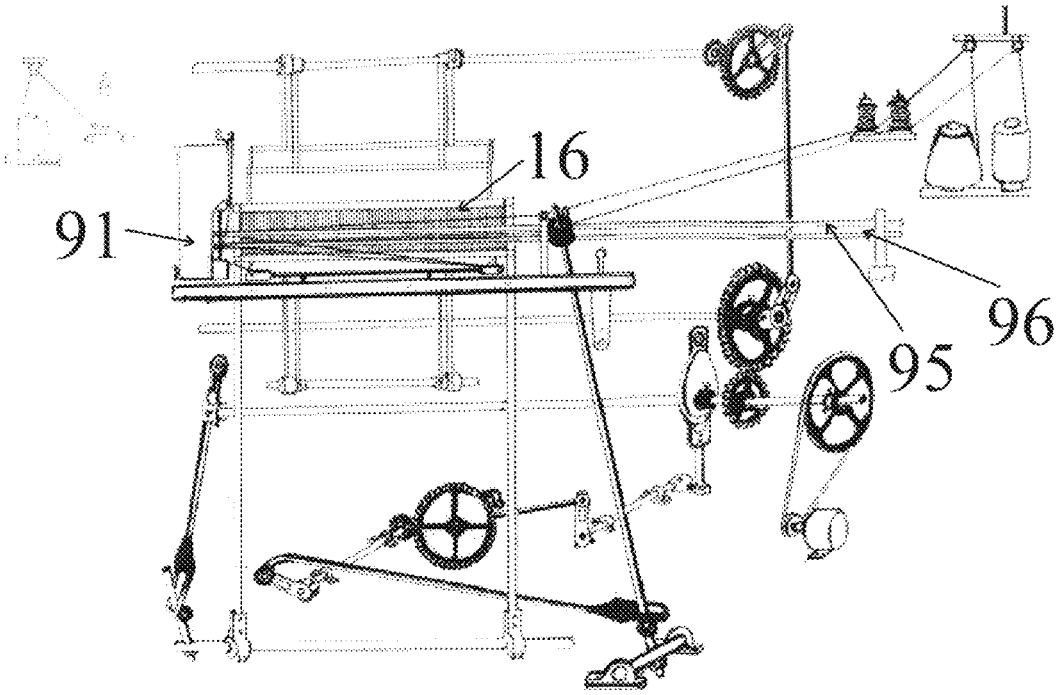
FIG. 13 illustrates a single loom with two rapiers.

FIGS. 3 and 13 illustrate a single loom but use two rapiers.

Figure 14:
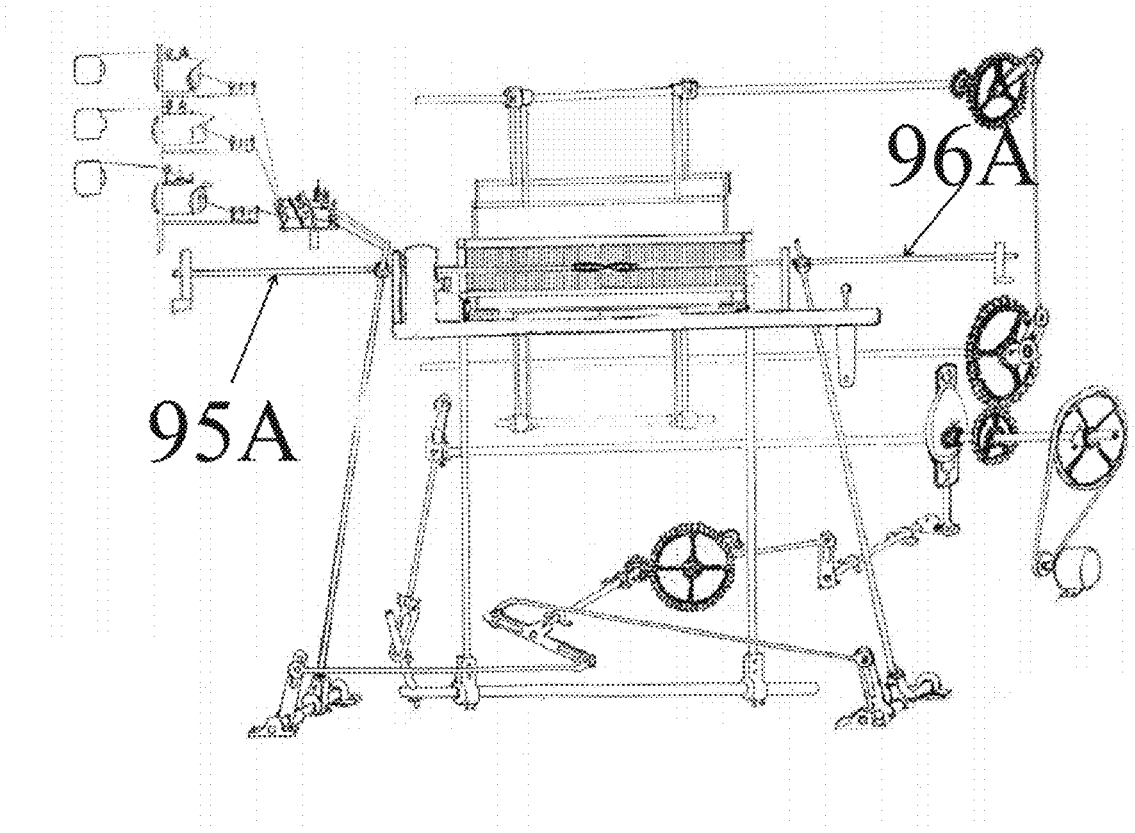
FIG. 14 illustrates a different embodiment of a rapier loom.

FIG. 14 illustrates a different embodiment of a rapier loom. Here, rapiers from either side meet at the centre where exchange of thread occurs.

Alternatively, this power loom is a shuttle-less power loom. Hence, a cone is used directly.

It is to be understood that the worm and worm wheel, the gear assembly, the V-belt gears (or chain assembly) are interchangeable wherever disclosed in the specification, in order to suit the requirement.

The loom of this invention provides the following advantages and uses:

1) make heavy carpets and rugs;
2) make unique design on cloth or fabric;
3) can be used to make different designs on either side of a cloth of fabric;
4) substantial reduction in labour charges;
5) substantial increase in production;
6) zero wastage;
7) cut border and no wastage.

The power loom can achieve improved gradation of cloth. Hence, better cloth material can be manufactured. The working of frames is smooth, in this power loom. Also, due to action of rocking frame, the cloth quality is improved. Also, low cotton/fibre quality yarn may be used in this power loom due to smooth working of frames.

According to this invention, there is further provided a Dobby machine adapted to be used with the power loom of this invention.

Figure 15:
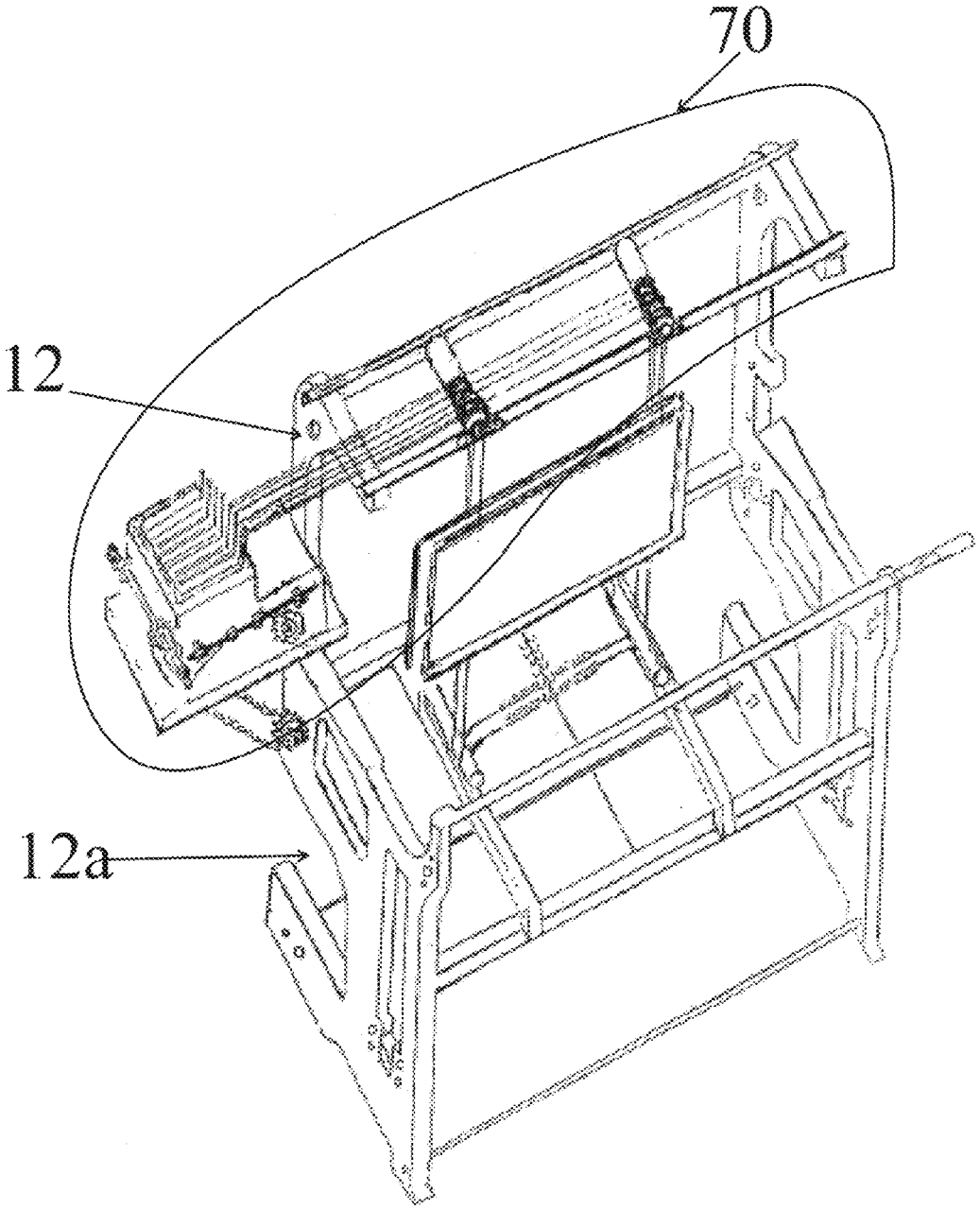
FIG. 15 illustrates a casting body or a framework of the power loom adapted to include a Dobby machine.

FIG. 15 illustrates a casting body or a framework of the power loom adapted to include a Dobby machine (70). Reference numeral 12 refers to the beam support. Reference numeral 12*a* refers to the open area.

Figure 16:
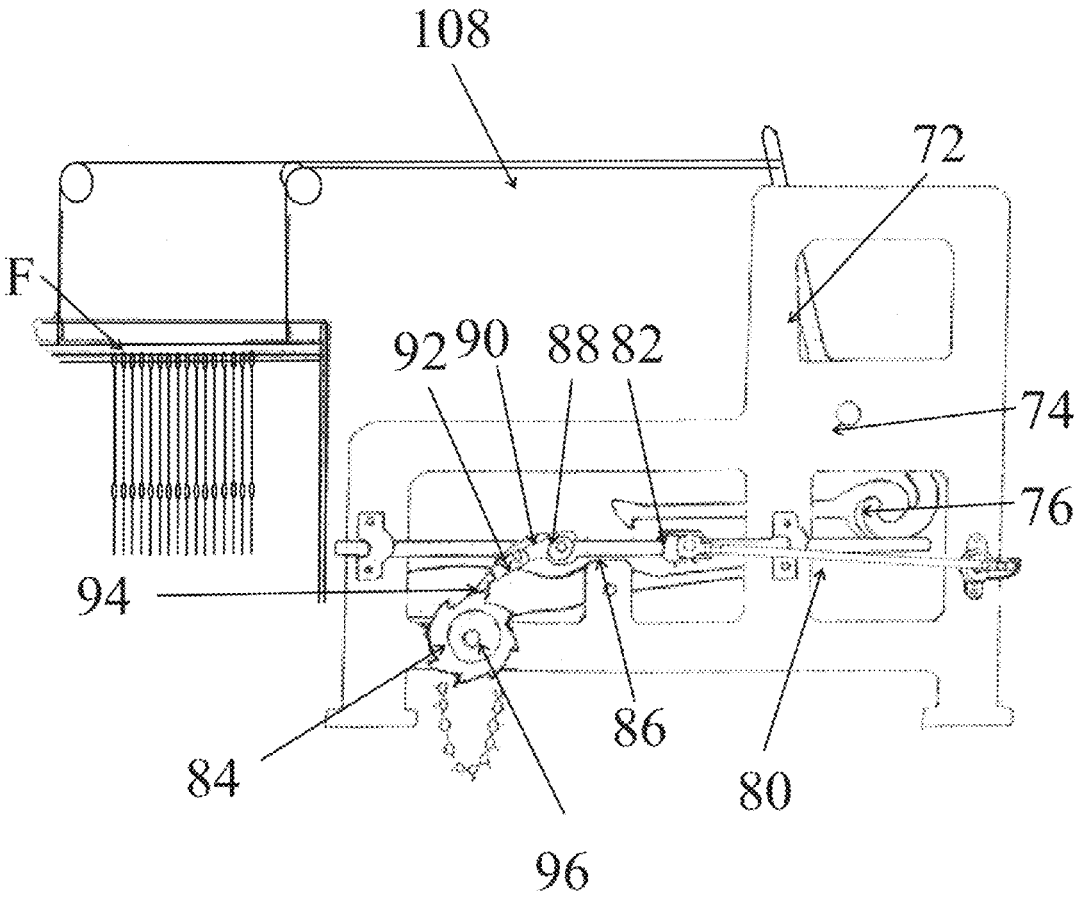
FIG. 16 illustrates a front view of the Dobby machine of FIG. 15.
Figure 17:
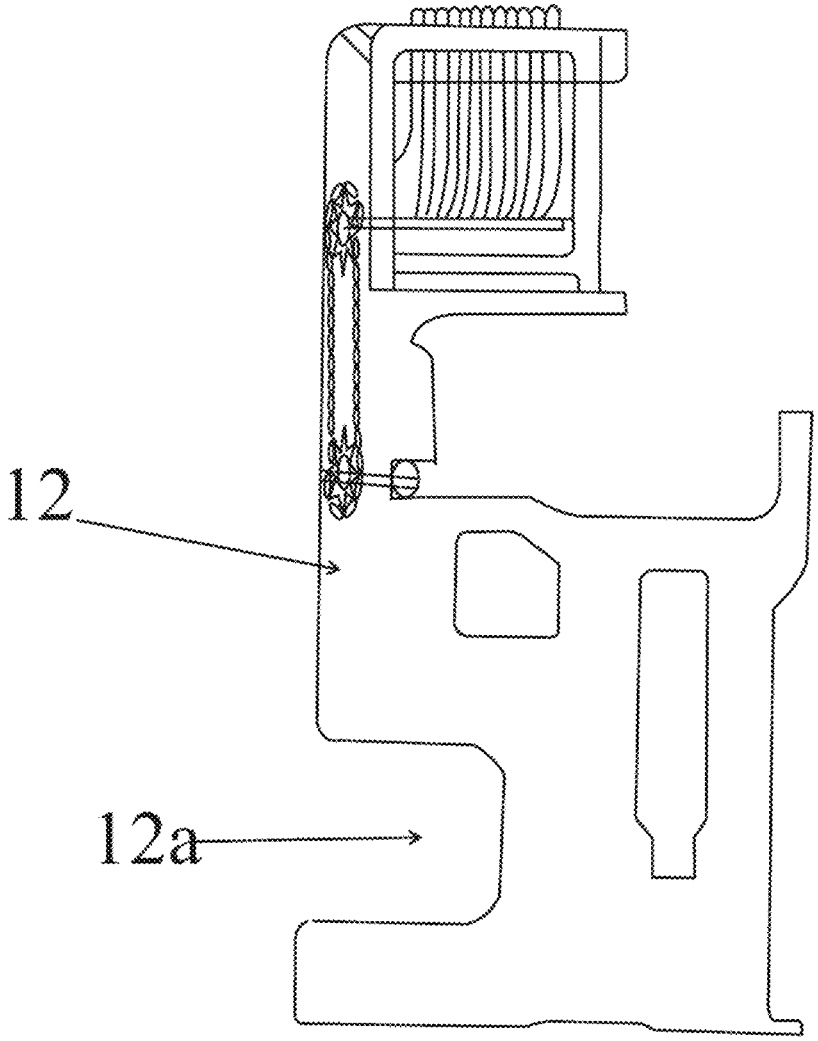
FIG. 17 illustrates a side view mounting of the Dobby machine of FIG. 15.
Figure 18:
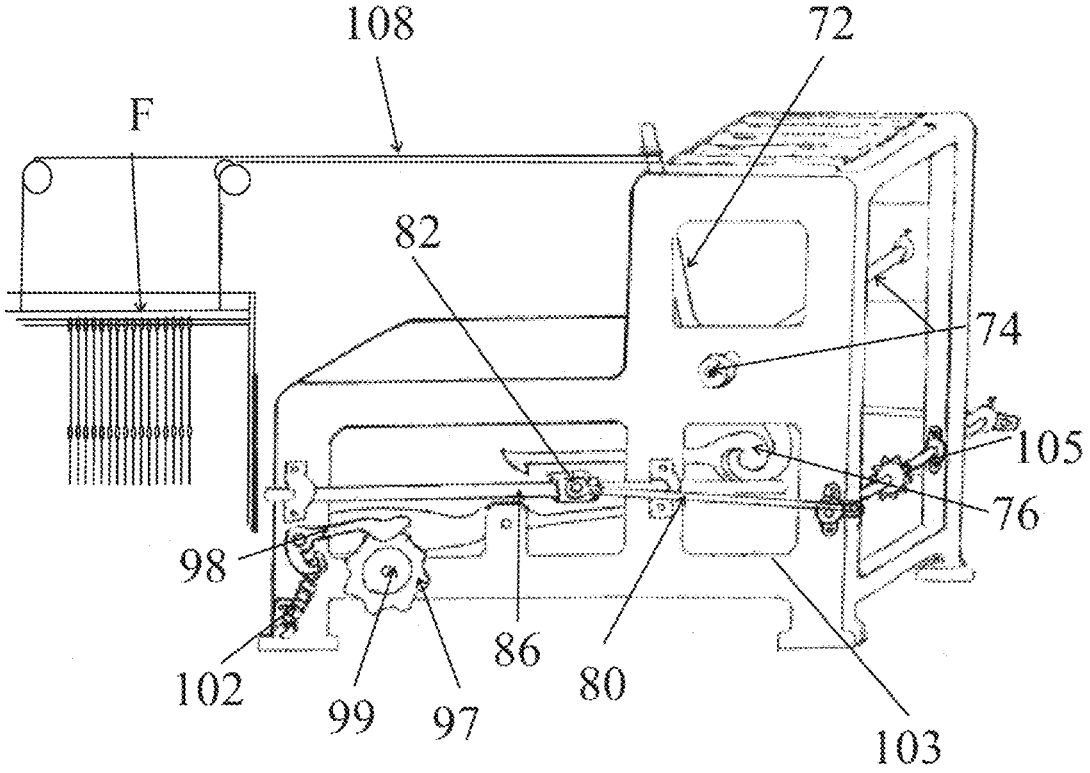
FIG. 18 illustrates a three-dimensional rear/back view of the Dobby machine of FIG. 15.
Figure 19:
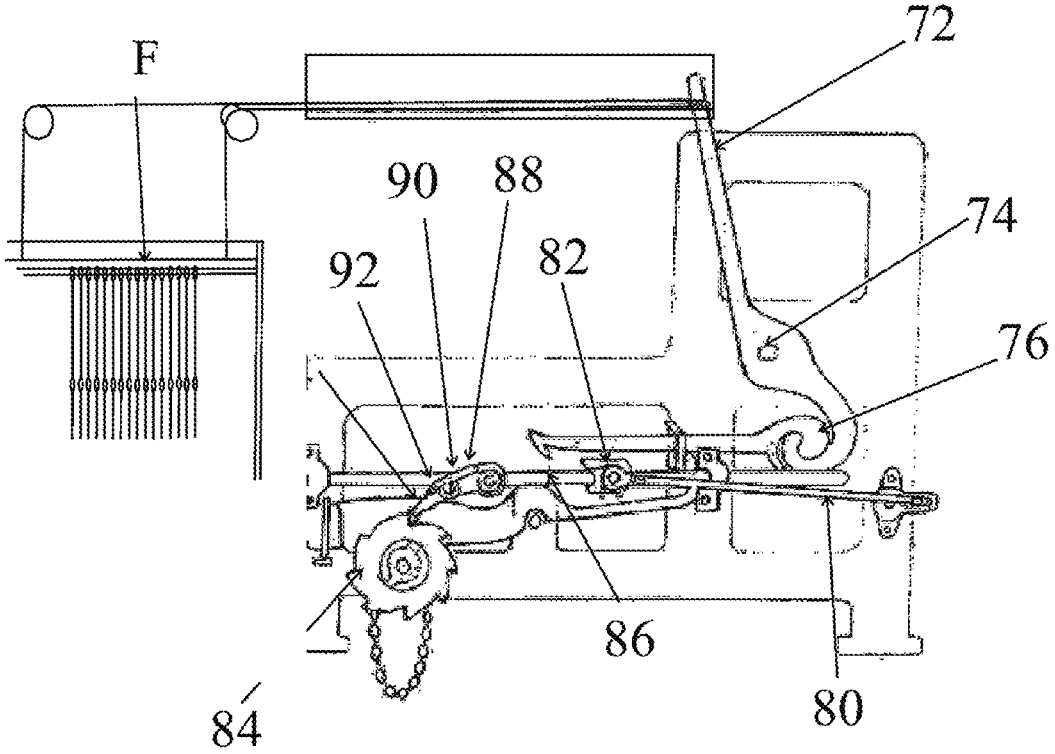
FIG. 19 illustrates the operative mechanisms, in part, of the Dobby machine of FIG. 15.

FIG. 16 illustrates a front view of the Dobby machine (70) of FIG. 15. FIG. 17 illustrates a side view mounting of the Dobby machine. FIG. 18 illustrates a three dimensional view of the Dobby machine of FIG. 15, from the rear/back side. FIG. 19 illustrates the operative mechanisms, in part, of the Dobby machine of FIG. 15.

A jack (72) is adapted to be displaced in an operative forward and an operative backward direction. The jack is mounted on a jack shaft (74) which is seen clearly in FIG. 18 of the accompanying drawings. The shaft is adapted to be placed on the framework of the power loom, disclosed above, in a pre-defined configuration, advantageous to the assembly. The jack is adapted to be engaged with a catch lever (76). Also, the jack (72) is adapted to be engaged with a connecting collar shaft (80) and a knife (82) at its operative distal end. The knife is adapted to move in an operative forward and operative backward direction. In its operative forward direction of motion, the knife (82) engages with a catch wheel (84) with a spiked or toothed circumferential assembly. A bush bearing shaft (86), a push catch bush (88), a push catch plate (90), a push catch body (92), and a push catch pointer (94) are all advantageously aligned in order to effect the forward motion of the connecting collar shaft (80) and knife (82) on to the push catch pointer (94) such that it engages with catch wheel (84) in order to stop its angular displacement. In the backward direction of motion, the catch wheel (84) is disengaged from the catch pointer (94) and the knife (82) and connecting collar shaft (80) retract. This forward engagement and rearward disengagement is a cyclical operation. Further, in its operation, the jack (72) is displaced in a backward direction. This backwards motion results in pulling operation of frames (F) associated with the Dobby machine. The frames are tensioned frames. The upward motion of the frames (F) is due to the jack shaft and jack movement in the backward direction. The tension in the frames causes its downward movement, and thus, cyclical upward and downward motion of the frames is established in accordance with the working of the Dobby machine. The cyclical upward and downward motion of the frames is in correspondence with the forward and backward motion of the jack.

There are a plurality of jacks and there a plurality of frames connected to the jacks, respectively. The connection is by means of wires/ropes (108). The number of jacks equals number of frames.

At the operative back side, a barrel shaft (99) that is used to mount the catch wheel (84) on one side mounts a star wheel (97) on its other side. A locking mechanism effected by a locking lever (98) and a spring (102) is shown. A chain and chain wheel (103) drives a crank shaft (105). The crank shaft (105) is adapted to be associated with other and further assemblies for creating designs on a fabric to be woven using the power loom and Dobby machine of this invention.

Figure 20:
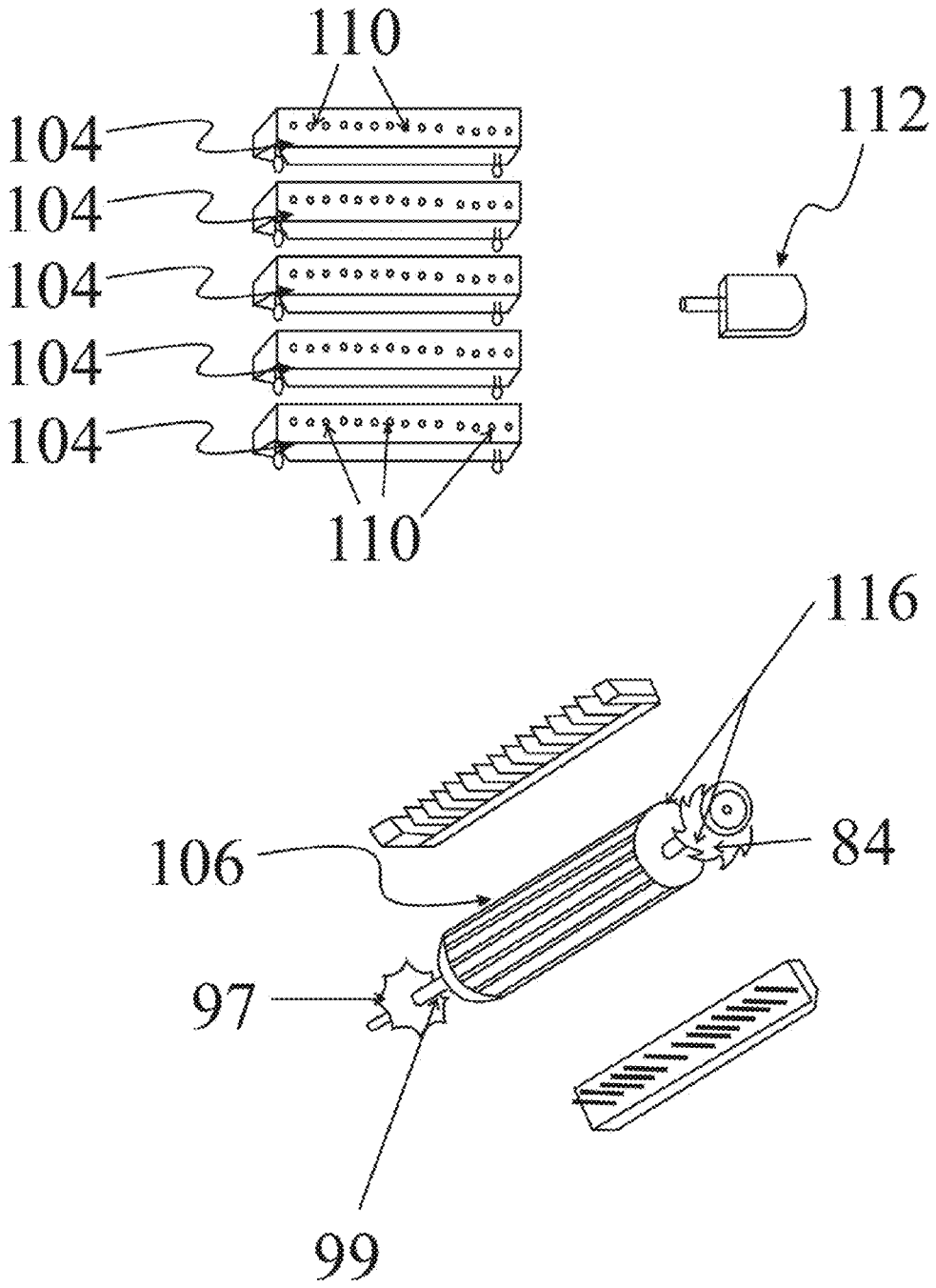
FIG. 20 illustrates internal parts for creating designs on a fabric to be woven using the power loom and Dobby machine of this invention.
Figure 21:
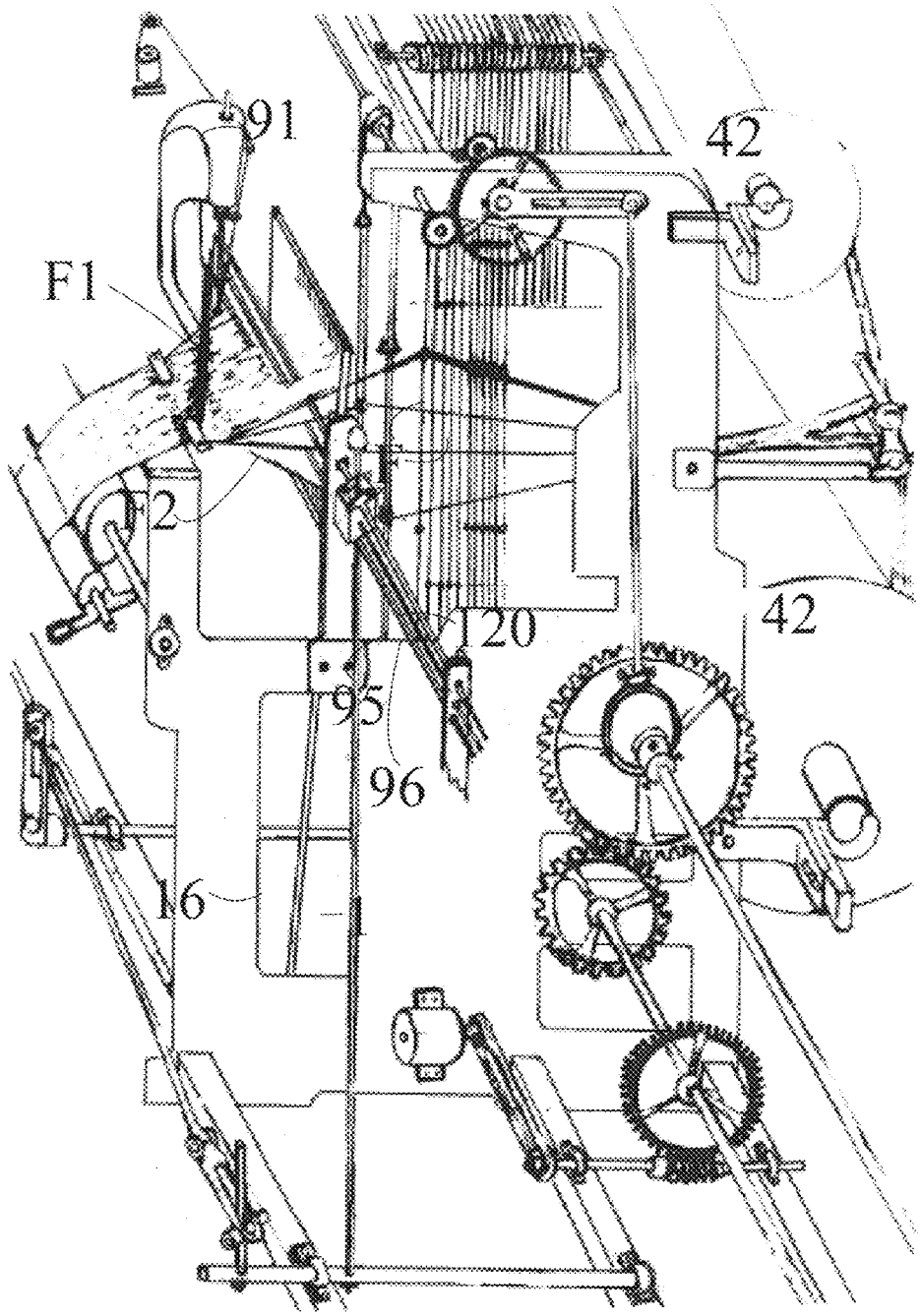
FIG. 21 illustrates a single Rapier loom with 3 Rapiers.
Figure 22:
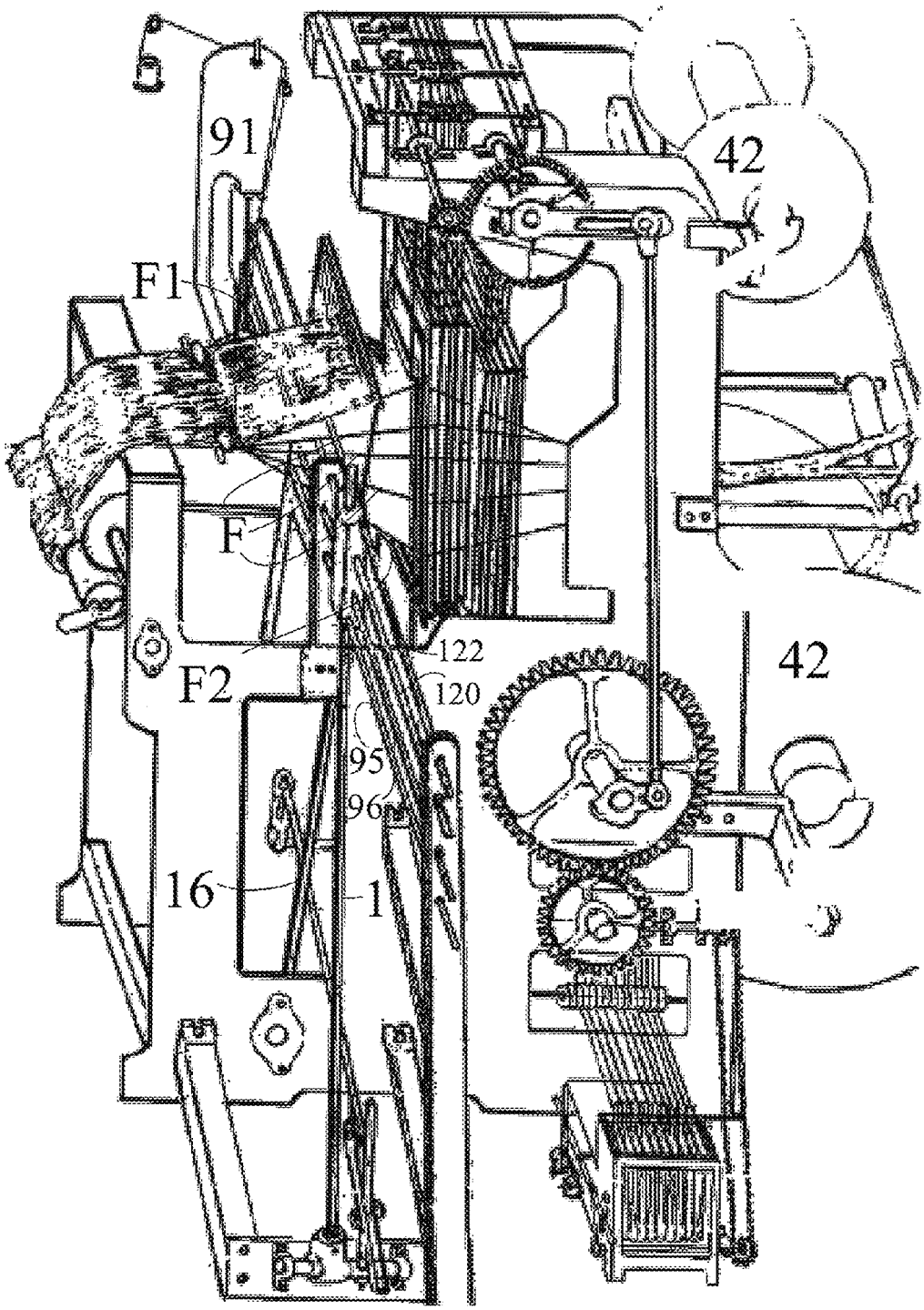
FIG. 22 illustrates a single Rapier loom with 4 Rapiers.

FIG. 20 illustrates internal parts for creating designs on a fabric to be woven using the power loom and Dobby machine of this invention.

In accordance with an embodiment of this invention, there is provided a barrel shaft (99) mounted barrel (106) adapted to include slotted bars (116) on its circumference. The slotted bars (116) are axial or longitudinal slotted bars with bars in the axial or longitudinal direction of the barrel shaft (99) and the slots in between two adjacent bars in the same axial or longitudinal direction of the barrel shaft (99). Further, there is provided a plurality of elongate bars (104) (lattice) adjacent each other. These elongate bars comprise a plurality of notches (110) on its operative top face, the notches being defined in a linear manner. These notches are adapted to receive stubs (112) in accordance with designs or patterns to be created on the fabric that is to be woven by the power loom and Dobby machine of this invention. The stubs (112) will be located in the notches (110) as and how required. As the barrel (106) is angularly displaced by the barrel shaft (99), it encounters the stubs on the notches as the barrel with slotted bars angularly displaces over the notched elongate bars comprising studs in a pre-determined manner. The stubs cause operative upwards motion of the barrel and the frames (F) move in accordance with this upward displacement. The various stubs force frames or various frames to be displaced operatively upwards. The number of frames equals number of jacks. Thus, the frames can be correspondingly displaced.

Figure 23:
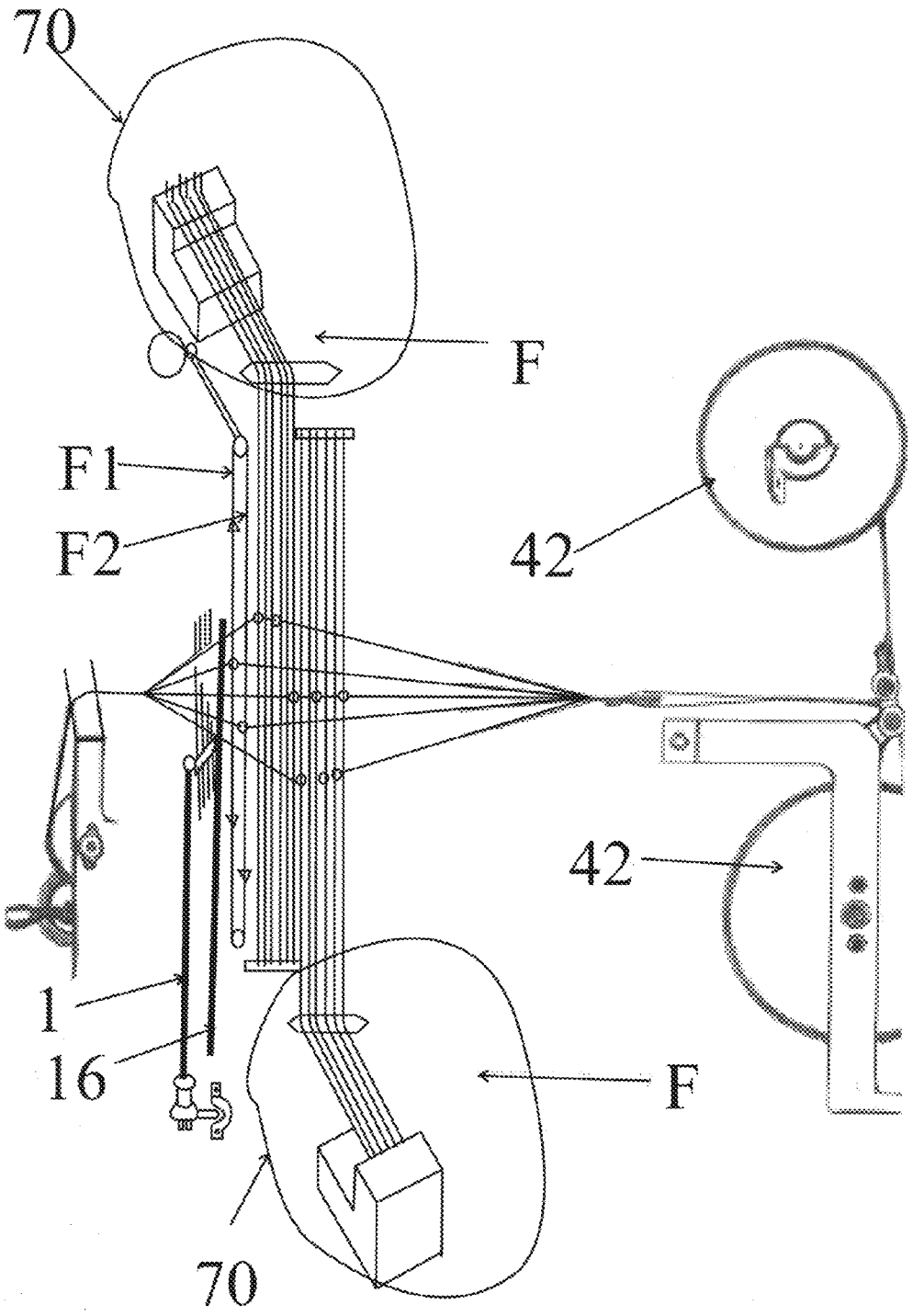
FIG. 23 illustrates a portion of the Rapier loom wherein two Dobby machines are used.

FIG. 23 illustrates a portion of the Rapier loom wherein two Dobby machines (70) are used.

Figure 25:
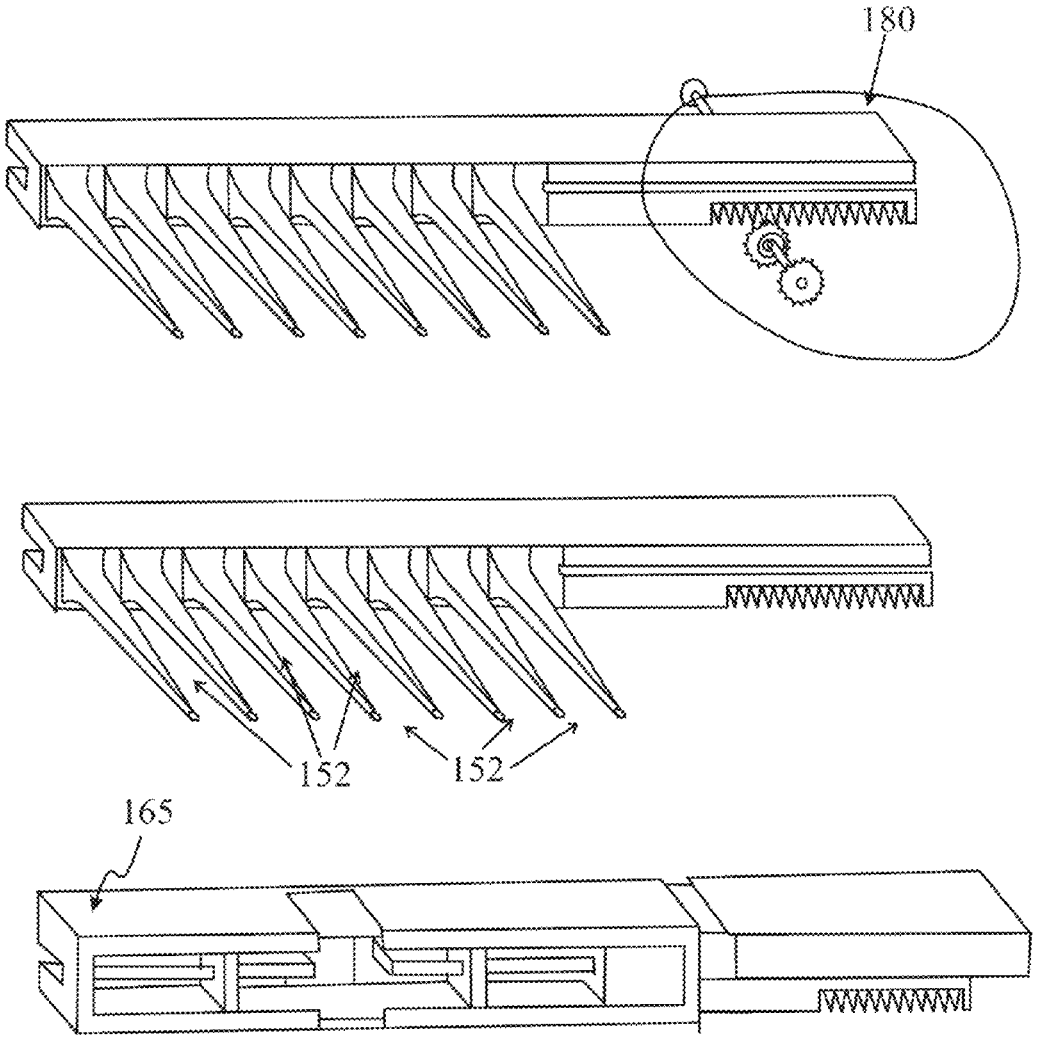
FIG. 25 illustrates a mechanism of a Rapier loom which aid in selection of threads for use.
Figure 26:
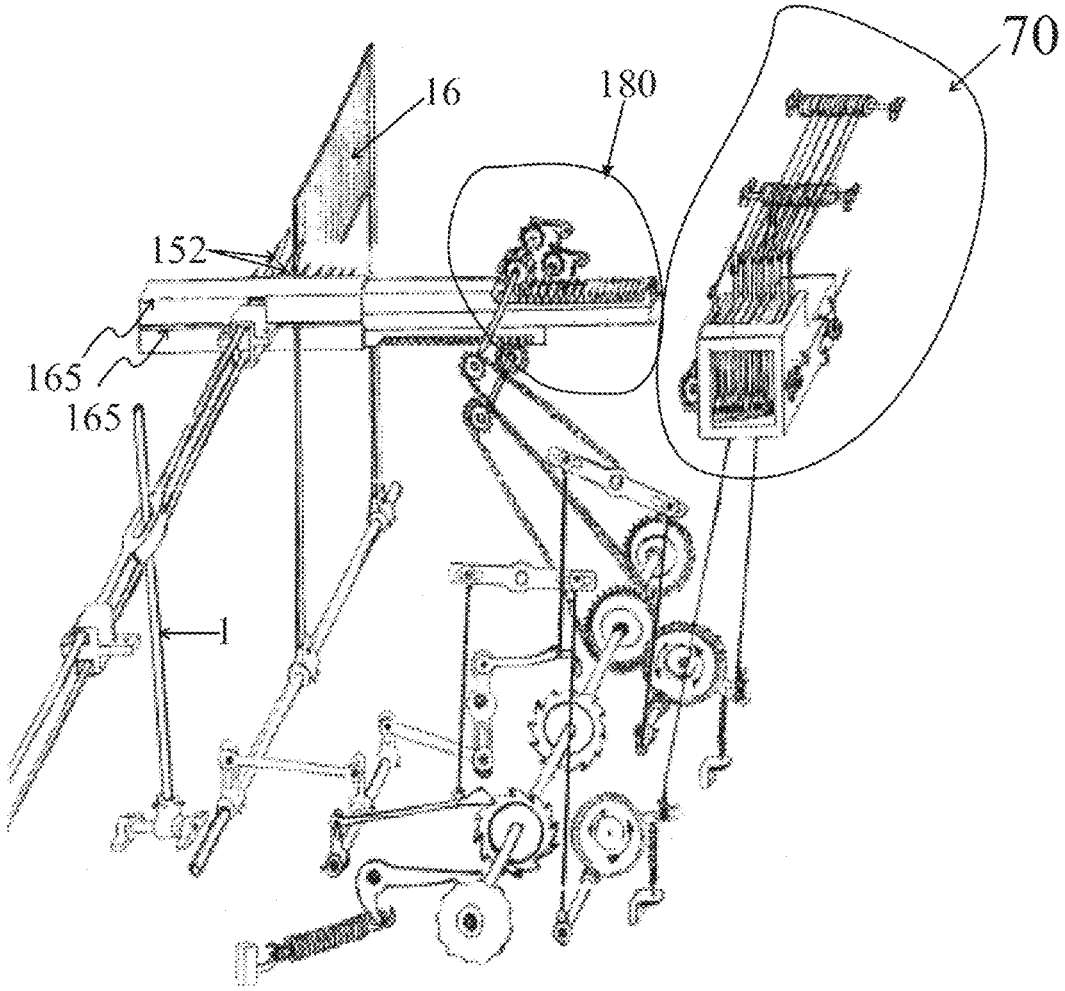
FIG. 26 illustrates a mechanism of a Rapier loom which aid in selection of threads for use.

FIGS. 24, 25, and 26 illustrate a mechanism of Rapier looms which aid in selection of threads for use.

In accordance with another embodiment of this invention, there is provided a first head portion (150) with a first head part (152) at its operative distal end and a recessed part (154) in the first head portion (150) at its operative proximal end. Typically, this first head part (152) is a tapering substantially pointed head part, Further, there is provided a second abutting portion (160) with a second head part (162) at its operative distal end. This second head part (162) is adapted to engage in to and disengage out of the recessed part of the first head portion (150). Spring loaded locking mechanisms (155) may be provided in order to allow for engaging and disengaging of the second portion with the first portion. A hole (158) is provided at the tip of the first head part (152) where a thread is engaged. A plurality of such first head portions (150) are linearly aligned on a block (165). This number may be up to 22 so that 22 different threads may be provided. Similarly, a plurality of the second abutment portions (160) are linearly aligned in a spaced apart manner from each other and also spaced apart from the first head portion (150). A user may select which thread is to be used and accordingly engages the second abutment portion (160) in to the first head portion (150) in order to engage the thread at the tip of the first head part (152) of the first head portion (150) with the fabric that is to be woven. Thus, weft colours can be easily changed. The block on which the first head portions and second abutment portions are aligned are co-operatively engaged with the Dobby machine (70). A rod (1) is provided which is relatively laterally stationary but moves operatively forward and backward in order to engage with the second abutment portion (160). A rack and pinion assembly (180) moves the blocks laterally in order to aid selection of a particular thread.

The mechanism of FIG. 26 is dependent on movement of rocking frame (16).

The entire description, above, is in relation to Dobby machine. However, it is to be understood that the Dobby machine can be replaced by a Jacquard machine with all the other features and enhancements and inventive step and novelty remaining constant.

While this detailed description has disclosed certain specific embodiments of the present invention for illustrative purposes, various modifications will be apparent to those skilled in the art which do not constitute departures from the spirit and scope of the invention as defined in the following claims, and it is to be distinctly understood that the foregoing descriptive matter is to be interpreted merely as illustrative of the invention and not as a limitation.

The invention claimed is:

1. A Rapier loom comprising:

at least a main support beam pipe on a framework, said main support beam pipe being located posterior on said framework;

at least a yarn shaft located on said main support beam pipe in order to accommodate yarns;

rocking frame located on the internal side of said framework;

at least a gear being located on said beam pipe, on a first lateral side of said framework, said gear adapted to drive said rocking frame in its rocking manner, for weaving operation of said loom;

at least a rod, located on a second lateral side of said framework, said rod comprising a first worm and worm wheel on its operative top side and a bevel gear at its operative bottom side; and at least a gear assembly connected to a pair of frames such that the movement of gears facilitates the movement of frames in an upward and downward direction opposite to each other's movements, wherein, at least a first Rapier is provided between at least a first frame from said pair of frames and at least a Dobby frame of a Dobby machine communicably coupled with said loom, said Rapier being adapted to be operatively horizontally displaced, and at least a second Rapier is provided between at least a second frame from said pair of frames and at least a Dobby frame of a Dobby machine communicably coupled with said loom, said Rapier being adapted to be operatively horizontally displaced.

2. A Rapier loom as claimed in claim 1 wherein, said loom further comprises at least an angularly or linearly displaceable shaft, said displacement further providing operative lateral movement to at least a first link arm with a distal slot in which an operative vertical rod or main shaft is located, said vertical rod or main shaft being a link and driving force for at least an operatively horizontally located rapier wherein, in once cycle, while a rocker arm completes one cycle of rocking motion, said at least a first or second rapier moves from an operative center to operative left and back to said operative center, and further while one needle moves up and down, a rapier thread or threads engages with a needled thread or threads and moves back to a center position.

3. A Rapier loom as claimed in claim 1 wherein, said loom further comprises at least a first sewing assembly with a needle holder and a needle such that that is engaged with said needle by means of said thread holder, and wherein said sewing assembly and the Dobby machine operates from at least a first shaft.

4. A Rapier loom as claimed in claim 1 wherein, said at least a first or second rapier is induced with laterally oriented repetitive motion in relation to the lateral movement of said first link arm, said at least a first or second rapier being adapted to receive threads from yarns, said threads from said rapiers being laterally moved along with said at least a corresponding rapier and engaging with a thread of a needle of a sewing assembly.

5. A Rapier loom as claimed in claim 1 wherein, said at least a first or second rapier comprises an angularly displaceable frame which is angularly displaceable about a shaft such that as said first shaft is angularly displaced, a second link arm with a distal slot is laterally moved, which, in turn, moves said shaft in an angularly displaceable manner.

6. A Rapier loom as claimed in claim 1 wherein, a needle assembly is located at either ends of said first or second rapier such that when said first or second rapier moves towards one end, it engages with the needled thread at one end, and then moves to the other end to engage with the needled thread at the other end.

7. A Rapier loom as claimed in claim 1 wherein, said first and second rapiers engage with an assembly for selection of threads, based on motion of said rocking frame, said assembly comprising:

at least a first head portion with a first head part at its operative distal end and a recessed part in said first head portion at its operative proximal end, said first head part is a tapering substantially pointed head part, at least a second abutting portion with a second head part at its operative distal end, said second head part is adapted to engage in to and disengage out of said recessed part of said first head portion;

locking mechanisms provided in order to allow for engaging and disengaging of said second portion with said first portion;

at least a hole provided at the tip of said first head part where a thread is engaged;

at least a plurality of such first head portions are linearly aligned on a block, said first head portions being equivalent to the number of different threads that may be provided for use with rapiers;

a plurality of the second abutment portions linearly aligned in a spaced apart manner from each other and also spaced apart from said first head portion such that a user may select which thread is to be used and accordingly engages said second abutment portion in to said first head portion in order to engage said thread at the tip of said first head part of said first head portion with the fabric that is to be woven, thereby allowing weft colours to be easily changed and wherein the block on which said first head portions and said second abutment portions are aligned are co-operatively engaged with at least the Dobby machine;

at least a rod provided which is relatively laterally stationary but moves operatively forward and backward in order to engage with said second abutment portion; and at least a movement assembly adapted to move said blocks laterally in order to aid selection of a particular thread.

8. A Rapier loom as claimed in claim 1 wherein, said loom further comprises at least two Dobby machines wherein a first Dobby machine is an operatively top located Dobby machine or a second Dobby machine is an operatively bottom located Dobby machine.

9. A Rapier loom as claimed in claim 1 wherein, said Dobby machine comprising:

a jack adapted to be displaced in an operative forward and an operative backward direction, said jack being mounted on a jack shaft, said jack shaft being adapted to be placed on said framework of said loom, in a pre-defined configuration;

a catch lever adapted to engage said jack;

a connecting collar shaft with a knife at its operative distal end, said connecting collar shaft adapted to engage with said jack, said knife being adapted to move in an operative forward and operative backward direction;

a catch wheel adapted to be engaged with said knife in the operative forward direction of said knife, said catch wheel being a spiked or toothed circumferential assembly, said catch wheel being further adapted to be disengaged from said knife in the operative backward direction of said knife, said forward engagement and rearward disengagement being a cyclical operation; and a bush bearing shaft, push catch bush, a push catch plate, push catch body, and push catch pointer being advantageously aligned in order to effect the forward motion of said connecting collar shaft and said knife on to a push catch pointer such that it engages with said catch wheel in order to stop its angular displacement.

10. A Rapier loom as claimed in claim 1 wherein, said Dobby machine comprises frames adapted to be displaced in an operative backward direction, when said jack is displaced in an operative backward direction, said backwards motion resulting in pulling operation of said frames, said frames being tensioned frames such that an operative upward motion of said frames is due to said jack shaft and jack movement in the backward direction and further such that said tension in said frames causes its downward movement, and thus, cyclical upward and downward motion of the frames is established in accordance with the working of said Dobby machine, said cyclical upward and downward motion of said frames being in correspondence with said forward and backward motion of said jack.

11. A Rapier loom as claimed in claim 1 wherein, said Dobby machine comprises:

a barrel shaft mounted barrel adapted to include slotted bars on its circumference, said slotted bars being axial or longitudinal slotted bars with bars in the axial or longitudinal direction of the barrel shaft and the slots in between two adjacent bars in the same axial or longitudinal direction of said barrel shaft;

a plurality of elongate bars adjacent each other, said elongate bars comprising a plurality of notches on its operative top face, said notches being defined in a linear manner and further being adapted to receive stubs in accordance with designs or patterns to be created on the fabric that is to be woven by said loom and said Dobby machine; and stubs being located in said as and how required in accordance with the pattern to be weaved along with said fabric, such that as said barrel is angularly displaced by said barrel shaft, it encounters said stubs on said notches as the barrel with slotted bars angularly displaces over the notched elongate bars comprising studs in a pre-determined manner, thereby causing operative upwards motion of said barrel and said frames due to said stubs, said various stubs forcing frames or various frames to be displaced operatively upwards.

12. A Rapier loom as claimed in claim 1 wherein, said loom further comprises:

said framework such that a first shaft being a crank shaft being operatively transversely located at a first pre-defined position across said framework;

said framework such that a yarn shaft being operatively transversely located at a second pre-defined position across said framework, said yarn shaft being adapted to accommodate multiple yarns fitted around it may be transversely located;

said framework such that a bearing support being transversely located at a third pre-defined position across said framework;

said framework such that a second shaft being operatively transversely located at a fourth pre-defined position across said framework;

said framework such that a third shaft being operatively transversely located at a fifth pre-defined position across said framework;

said framework such that a fourth shaft being operatively transversely located at a sixth pre-defined position across said framework;

said framework such that a fifth shaft being operatively transversely located at a seventh pre-defined position across said framework;

said framework such that a pre-defined first shaft being placed over a pre-defined second shaft;

said framework such that a pre-defined third shaft being placed over a pre-defined first shaft;

said framework such that a pre-defined fourth shaft being placed over a pre-defined third shaft;

said framework such that a pre-defined third shaft being coupled to a pre-defined fourth shaft by a gear assembly; and said framework such that a pre-defined fourth shaft being moved by said second shaft.

13. A Rapier loom as claimed in claim 1 wherein, said Rapier loom further comprises a switch with a three phase supply adapted to control mode of working of said loom, said modes being selected from a forward direction mode or a reverse direction mode, said switch comprising an electric changer connected to a lever, position of said lever adapted to decide a signal that is given from said electric changer to an electric motor such that a first position of lever stops said motor, a second position of lever operates said motor in a clockwise rotation, and a third position of lever operates said motor in an anti-clockwise rotation.

14. A Rapier loom as claimed in claim 1 wherein, said rocking frame comprising:

a first arm being an effort arm;

a second arm being a load arm and a weighted arm;

a fulcrum between said first arm and said second arm;

a motor adapted to swing or rock said first arm and thereby adapted to rock/swing said second arm in an opposite direction, said weighted second arm adapted to reverse push or pull of said motor, thereby bringing said rocking frame in position; and a hook or latch adapted for actuation of said rocker frame or of the shuttle operation.

15. A Rapier loom as claimed in claim 1 wherein, said loom further comprises a rolling means adapted to rolls woven fabric, said rolling means further comprising:

plurality of rollers adjacent each other so as to roll a fabric that is received between it;

a frame assisting in the support of said rollers;

a beam being a notched beam which includes notches for co-operating with a gear assembly for adjusting the position of a first roller with respect to a second roller in relation to the thickness of aid woven fabric to be rolled; and a spring adapted to hold said second roller in place.

16. A Rapier loom as claimed in claim 1 wherein, said loom further comprises attachments, said attachments being selected from a group of attachments consisting of a 4×4 box, a 4×1 box, a 2×1 box, a Dobby machine or a Jacquard machine and tappets.

17. A Rapier loom as claimed in claim 1 wherein, said Rapier loom is a shuttle-less power loom.

18. A Rapier loom as claimed in claim 1 wherein, said Dobby machine is Jacquard machines or any other design machine.

19. A Rapier loom as claimed in claim 1 wherein, said loom further comprises at least two Rapiers axially aligned facing each other such that said at least two Rapiers from either side meet at a center, in response to operating cycles, where exchange of thread occurs.

20. A Rapier loom as claimed in claim 1 wherein, said loom being one of at least a single loom assembly or a double loom assembly, said loom assembly with at least two Rapiers.

* * * * *